US012716680B1

(12) United States Patent
Maschin et al.

(10) Patent No.: US 12,716,680 B1
(45) Date of Patent: Aug. 25, 2026

(54) PNEUMATIC LAUNCHING APPARATUS WITH POSITIONING OF PLURAL ROUNDS FROM BREECH TO ALIGNMENT PASSAGES OF BARRELS AND METHODS

(71) Applicant: Hasbro, Inc., Pawtucket, RI (US)

(72) Inventors: Robert C Maschin, Johnston, RI (US); David Drew Weiand, Johnston, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 18/921,592

(22) Filed: Oct. 21, 2024

Related U.S. Application Data

(60) Provisional application No. 63/592,414, filed on Oct. 23, 2023.

(51) Int. Cl.
*F41B 11/641* (2013.01)
*F41B 11/52* (2013.01)

(52) U.S. Cl.
CPC ..... *F41B 11/641* (2013.01); *F41B 11/52* (2013.01)

(58) Field of Classification Search
CPC ..... F41B 11/52; F41B 11/641; F41B 11/642; F41B 11/643; F41B 11/64; F41B 11/646; F41B 11/647; F41B 11/648
USPC ..... 124/71
See application file for complete search history.

(56) References Cited

U.S. PATENT DOCUMENTS

| | | | | | |
|---|---|---|---|---|---|
| 46,617 | A | * | 3/1865 | Allen | F41A 3/58 42/12 |
| 159,609 | A | | 2/1875 | Prescott | |
| 956,760 | A | | 5/1910 | Moulin | |
| 1,441,975 | A | | 1/1923 | Edelin | |
| 1,488,995 | A | | 4/1924 | McCollom | |
| 1,743,576 | A | | 1/1930 | Smith | |
| 1,873,677 | A | | 8/1932 | Traver | |
| 2,214,224 | A | | 9/1940 | Douglas | |
| 2,483,752 | A | | 10/1949 | Buhl | |
| 2,634,717 | A | | 4/1953 | Junkin | |
| 2,725,868 | A | | 12/1955 | Foster | |
| 2,737,942 | A | * | 3/1956 | Horowitz | F41B 7/006 124/52 |
| 3,054,536 | A | | 9/1962 | Sagarin | |
| 3,262,440 | A | | 7/1966 | Kuhn | |
| 3,385,279 | A | | 5/1968 | Pitcher | |
| 3,420,133 | A | | 1/1969 | Proll | |
| 3,465,744 | A | * | 9/1969 | Nielsen | F41B 7/02 124/31 |
| 3,584,614 | A | | 6/1971 | Horvath | |
| 3,847,132 | A | | 11/1974 | Schatz | |

(Continued)

*Primary Examiner* — John Cooper
(74) *Attorney, Agent, or Firm* — Perry Hoffman

(57) ABSTRACT

Launcher apparatus and methods for toy projectile blaster air compression element cylinders with elongated breech bolts for fluid communication in alignment with projectile launching barrels capable of receiving and positioning two or more rounds advanced within the barrels from breech bolts. The piston is primed and prevented from advancing once retracted with a lock and catch mechanism. An interlock and pathway prevents subprime strokes. The air compression element receives the piston for generating fluid communication to outwardly launch received projectile rounds. The breech can receive projectiles with the breech bolt of the air compression element extending into the breech to position received projectiles into barrels.

14 Claims, 25 Drawing Sheets

(56) References Cited

U.S. PATENT DOCUMENTS 3,990,426 A 11/1976 Stokes
4,094,294 A 6/1978 Speer
4,345,578 A 8/1982 Speer
4,597,527 A * 7/1986 Sands ..... F41B 9/0075 239/394
4,774,929 A 10/1988 Millman
4,841,945 A 6/1989 Braden
4,890,404 A 1/1990 Ferri
5,205,271 A 4/1993 Salva
5,244,153 A 9/1993 Kuhn et al.
5,267,549 A * 12/1993 Webber ..... F41B 11/641 124/59
5,343,850 A 9/1994 Steer
5,471,967 A 12/1995 Matsuzaki et al.
5,529,050 A 6/1996 D'Andrade
5,535,729 A * 7/1996 Griffin ..... F41B 11/64 124/66
5,704,150 A 1/1998 Millman
5,878,734 A 3/1999 Johnson et al.
6,067,975 A * 5/2000 Ginn ..... F41B 11/89 124/66
6,119,671 A 9/2000 Smith et al.
6,460,530 B1 10/2002 Backeris et al.
6,488,019 B2 12/2002 Kotsiopoulos
7,051,727 B2 5/2006 Wu
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,371,282 B2 2/2013 Meggs et al.
8,397,705 B2 3/2013 DeHaan et al.
8,402,956 B2 * 3/2013 Dakan ..... F41B 7/08 124/27
8,567,378 B2 10/2013 Nugent
8,640,683 B2 2/2014 Meggs et al.
8,695,579 B2 4/2014 Huebl
8,875,688 B2 11/2014 Nugent
9,097,476 B2 8/2015 Mead et al.
9,097,477 B1 8/2015 Mead et al.
9,389,042 B1 7/2016 Clayton
9,500,436 B2 11/2016 Macy
9,958,230 B1 5/2018 Nugent et al.
10,488,143 B2 11/2019 Victor et al.
10,488,148 B2 11/2019 Johnson et al.
10,823,527 B2 11/2020 Tino et al.
10,876,809 B1 12/2020 Kopman et al.
10,907,929 B2 2/2021 Bernal
12,422,214 B1 * 9/2025 Maschin ..... F41B 11/641
2002/0166551 A1 11/2002 Lee
2007/0034197 A1 2/2007 Tschech
2009/0095272 A1 4/2009 Zimmerman
2009/0145412 A1 6/2009 Barish
2010/0206281 A1 8/2010 Kanitz et al.
2012/0037135 A1 * 2/2012 Dakan ..... F41B 7/08 124/16
2013/0112184 A1 5/2013 Corsiglia et al.
2013/0146043 A1 6/2013 Zarecky et al.
2013/0312722 A1 11/2013 Price
2016/0018184 A1 1/2016 Park
2021/0148671 A1 * 5/2021 Pong ..... F41B 11/721
2024/0328748 A1 * 10/2024 Sweeting ..... F41B 11/73
2025/0354776 A1 * 11/2025 Huebner ..... F41B 7/08

* cited by examiner

PNEUMATIC LAUNCHING APPARATUS WITH POSITIONING OF PLURAL ROUNDS FROM BREECH TO ALIGNMENT PASSAGES OF BARRELS AND METHODS

FIELD OF THE INVENTION

The present invention relates generally to launcher apparatus and methods for a toy projectile blaster discharging projectiles such as foam rounds, balls, and flexible projectiles including hydrated super absorbent polymer (SAP) beads, and more particularly, for discharging plural projectile rounds in a novel fashion providing plural cylinders and plural elongated breech bolts of an air compression element having plural breech bolt channels extending therethrough for fluid communication from the cylinders in alignment with the projectile launching barrels, defining a breech capable of receiving and positioning two or more rounds advanced within the barrels with a lock and catch mechanism to prime the piston.

BACKGROUND OF THE INVENTION

Toys are often designed to have play value by simulating a real object, safely and at a reasonable expense. Toy launch apparatus have been marketed as toys for decades and include such devices as water pistols, toy BB rifles, foam projectiles, balls discs, dart blasters and NERF® brand launchers that discharge a soft foam dart. Most air launchers discharging projectiles use a launch spring, a piston and cylinder arrangement to generate the energy and direct that energy to cause the projectile to discharge. The launching apparatus themselves come in various forms, including those simulating rifles, guns, machine gun, shotguns, bows, rocket launchers, grenade launchers and foam car launchers. Generally, from design and function standpoints control of the size and operation of an air chamber in the cylinder is desirable for efficiency and cost considerations.

Projectile launch mechanisms are known in the art and include mechanisms for launching toy darts, balls of various sizes, paint balls, etc. Known projectiles also include spheres of hydrated super absorbent polymer beads, such as those disclosed in U.S. Pat. Nos. 8,371,282 and 8,640,683. These patents are incorporated herein by reference. As explained in the patents, super absorbent polymer beads are able to absorb extremely large amount of liquid relative to their own mass through hydrogen bonding with water molecules. Super absorbent polymer beads are soft projectiles that can maintain their shape under modest pressure such that they can be projected with reasonable force and velocity without breaking apart. Such super absorbent polymers are often referred to as "hydrogels" or simply as "gels." Examples of toy gel bead devices, marketed by Hasbro Inc., under the brands NERF® PRO GELFIRE™, and GEL BALL BLASTER™ include stylized toy rifles that launches gel balls or rounds. In the alternative made of NERF™ brand foam, a solid, spongy cellular material as projectiles.

The inventions discussed in connection with the described embodiments address these and other deficiencies of the prior. The features and advantages of the present inventions will be explained in or become apparent from the following summary and description of the preferred embodiments considered together with the accompanying drawings. The projectiles for such launching apparatus include foam balls of various sizes, and other soft projectiles.

SUMMARY OF THE INVENTION

In accordance with the present invention, an advantageous method and apparatus are provided in the form of a toy launch apparatus designed to discharge soft projectiles, with an advantageous method and system described with novel pneumatic launching apparatus with positioning of plural rounds from breech to alignment passages of barrels and methods, and piston latch and catch mechanism to prime the piston for timing firing of the piston.

Briefly summarized, the inventions relate to a toy launching apparatus capable of launching projectile rounds driven from piston air compression and breech bolt elements operating through a driving coupling between the elements to allow the piston air compression element to retract with the breech bolt element generating fluid communication to outwardly launch received projectile rounds. Plural cylinders and plural elongated breech bolts of the air compression element provides plural breech bolt channels extending therethrough for fluid communication from the cylinders in alignment with the projectile launching barrels, defining a breech capable of receiving and positioning two or more rounds advanced within the barrels with a lock and catch mechanism to prime the piston. A priming handle interlock prevents incomplete, partial or subprime strokes. The breech can receive projectiles with the breech bolt of the air compression element extending into the breech to position a received projectile through the barrel.

BRIEF DESCRIPTION OF DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

FIG. 4A shows the trigger being able to release the piston with the air compression element advanced. FIG. 4C shows the trigger being able to release the piston with the air compression element retracted. FIG. 4B shows a view of the blaster with cam and follower mechanisms connecting the air compression element to the rest of the mechanism shown in FIGS. 4A and 4C.

FIG. 6 shows an isometric view of the mechanism. FIG. 7. shows different steps of the interlock following the pathway.

FIG. 9 shows the priming handle fully advanced with the piston not primed in the lock and catch mechanism. FIG. 10 shows the priming handle retracted with the air compression element retracting the piston with the piston prevented from advancing by the lock and catch mechanism. FIG. 11 shows the priming handle advancing with the air compression element. The breech bolts position the projectile rounds. FIG. 11 shows the trigger being fired and releasing the piston, thereby firing the projectile rounds.

DETAILED DESCRIPTION OF THE EMBODIMENTS

Figure 1:
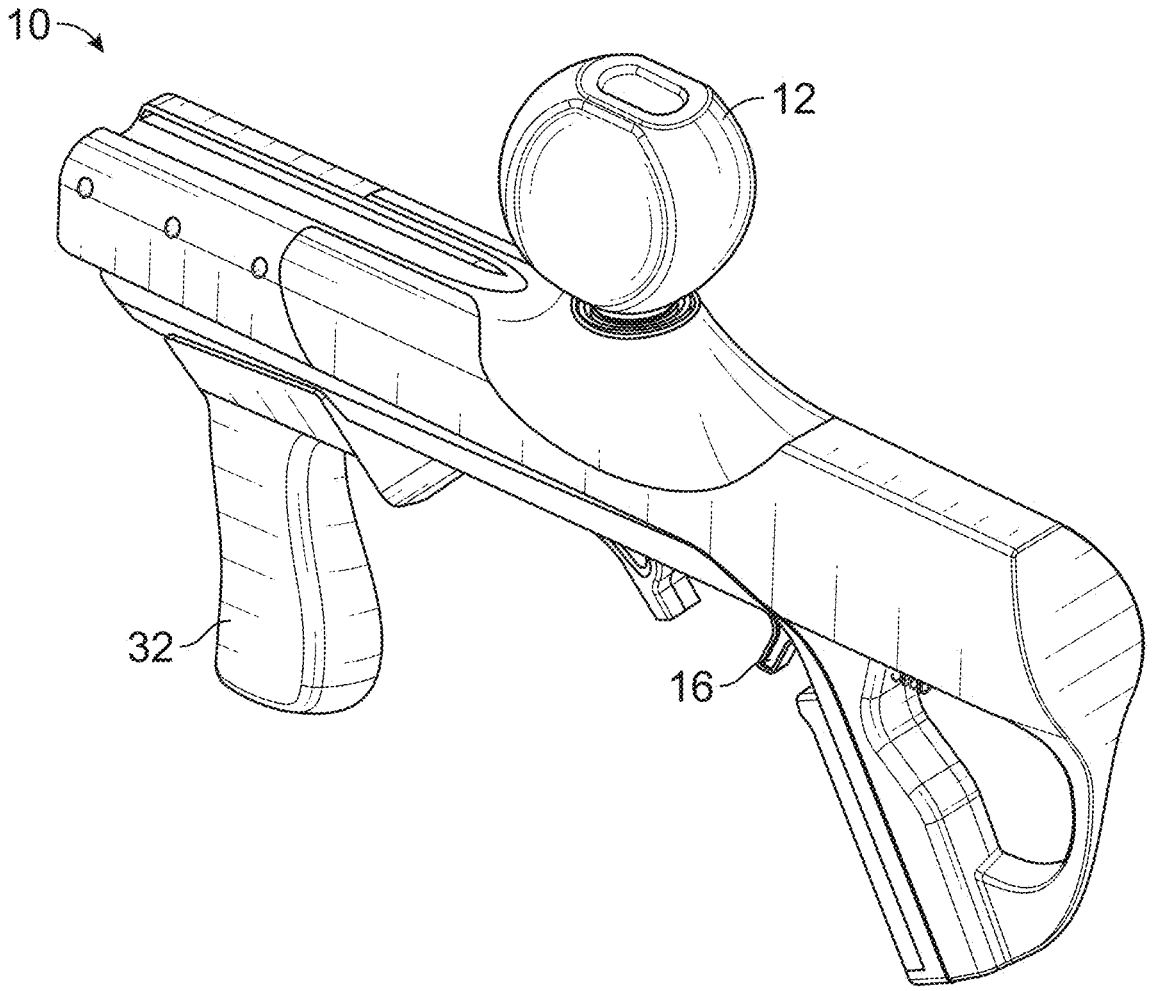
FIG. 1 is an isometric view of an assembled pneumatic launching toy projectile blaster embodiment with a projectile rounds hopper employing a user operated handle mechanism to fire projectile in accordance with the present invention in the form of blasters.

FIG. 1 shows the outside of the blaster 10. The blaster 10 has a priming handle 32, trigger 16 and hopper 12. The priming handle 32 and trigger 16 move longitudinally. Projectile rounds are loaded into the hopper 12. Two projectile rounds enter the breech 30 for each full retraction and advancement of the priming handle 32. The projectile rounds fire once the trigger 16 is pulled. Pulling the trigger 16 will not fire any projectile rounds until the priming handle 32 has fully retracted and advanced. Additionally, once the priming handle 32 has retracted slightly, it cannot fully advance until the priming handle 32 fully retracts.

Figure 2:
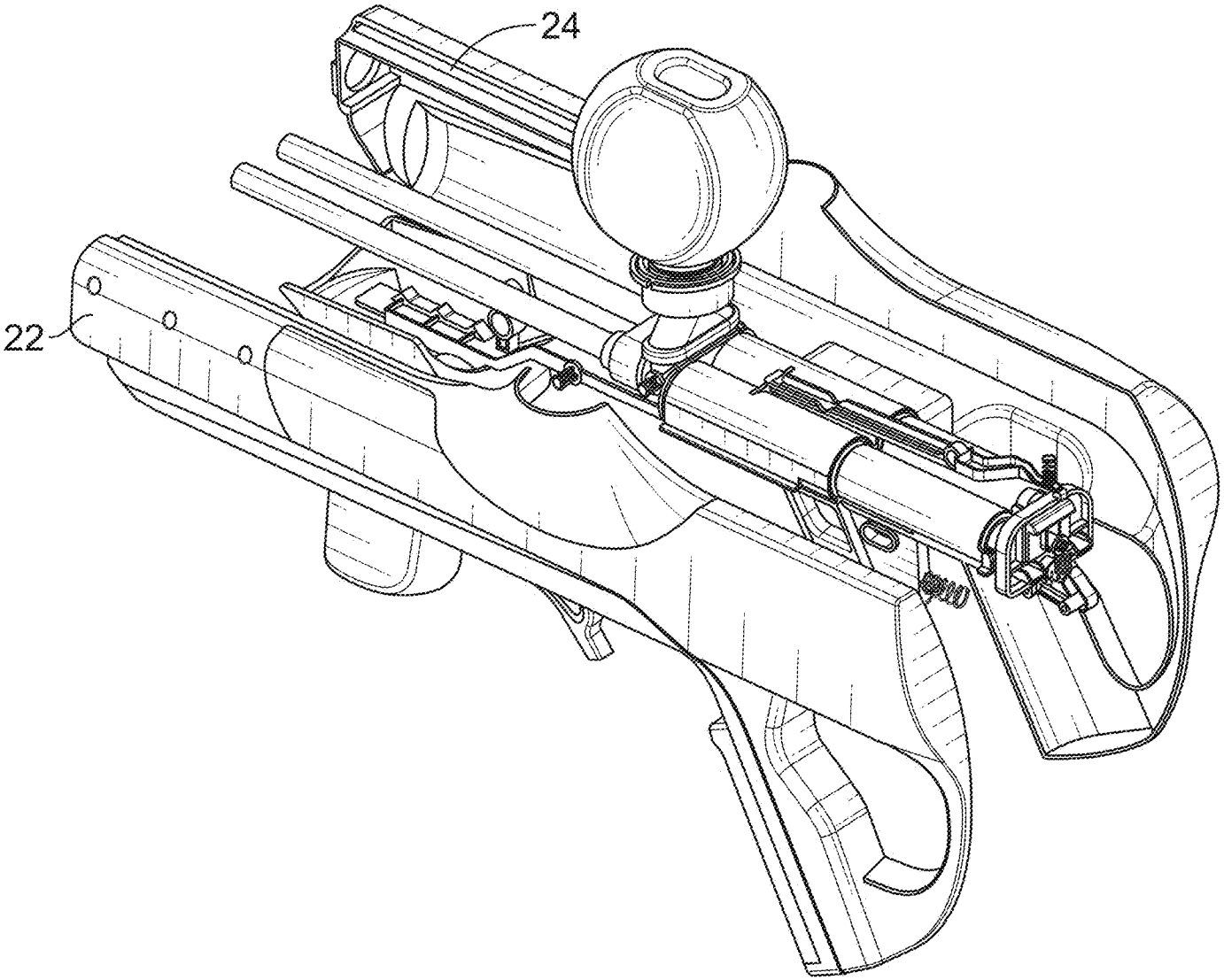
FIG. 2 is an exploded view of the blaster embodiment showing an internal firing mechanism partial subassembly unexploded assembly shown in perspective.

FIG. 2 shows the blaster 10 partially exploded. The blaster is housed by the left structural housing 22 and the right structural housing 24. The described air compression element cylinders with elongated breech bolts for fluid communication in alignment with projectile launching barrels capable of receiving and positioning two or more rounds advanced within the barrels from breech bolts. The piston is primed and prevented from advancing once retracted with a lock and catch mechanism. Another lock and catch mechanism prevents the air compression element from retracting once the air compression element has advanced and the piston is primed. An interlock and pathway prevents subprime strokes. The air compression element receives the piston for generating fluid communication to outwardly launch received projectile rounds. The breech can receive projectiles with the breech bolt of the air compression element extending into the breech to position received projectiles. The described latch and catch mechanism prevents the piston air compression element from advancing until the blaster is fired. The breech bolt element is connected to a cam and follower that can be disengaged preventing the trigger from releasing the piston air compression element.

Figure 3A:
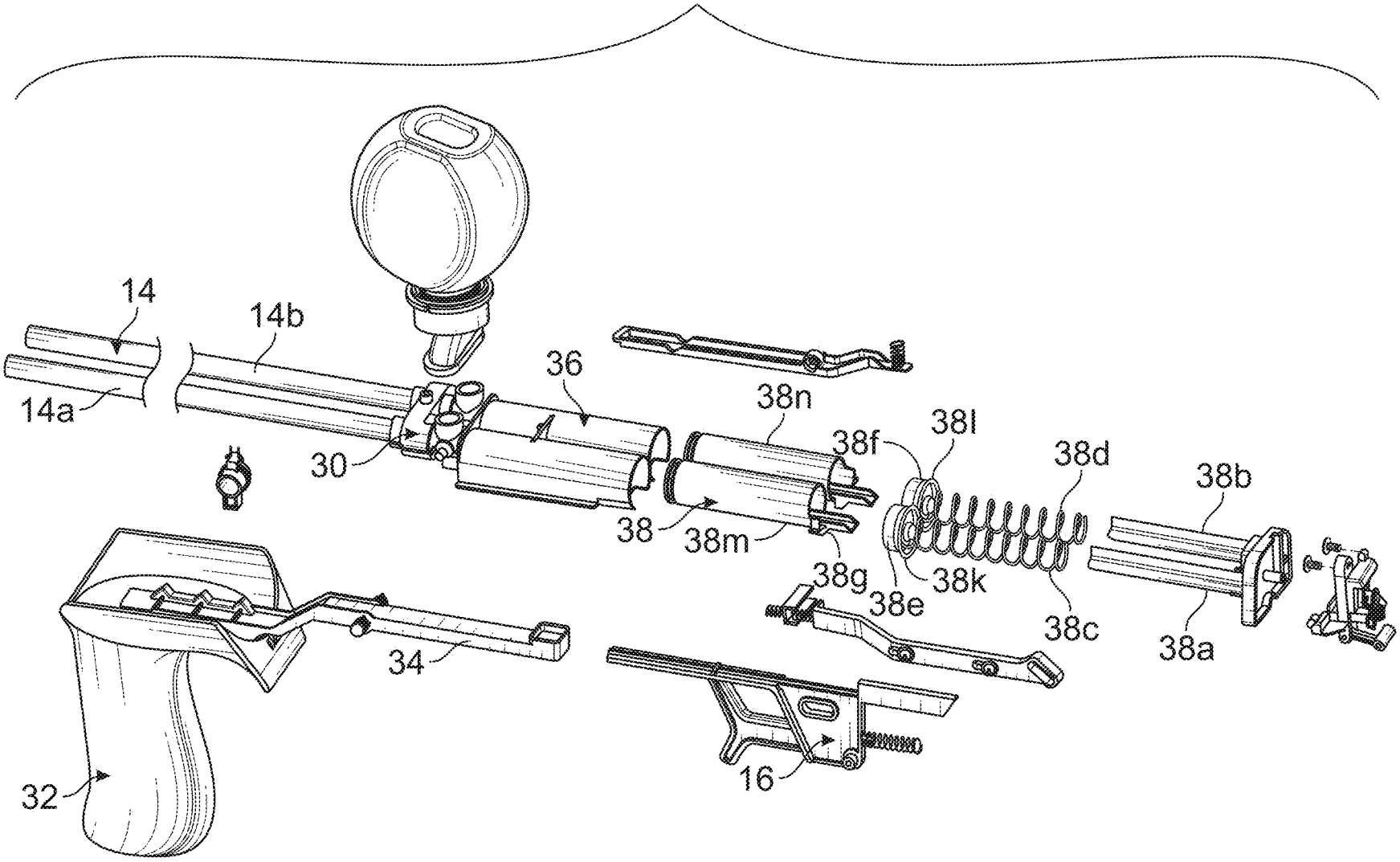
FIG. 3A shows and exploded view of the internal firing mechanism.
Figure 3B:
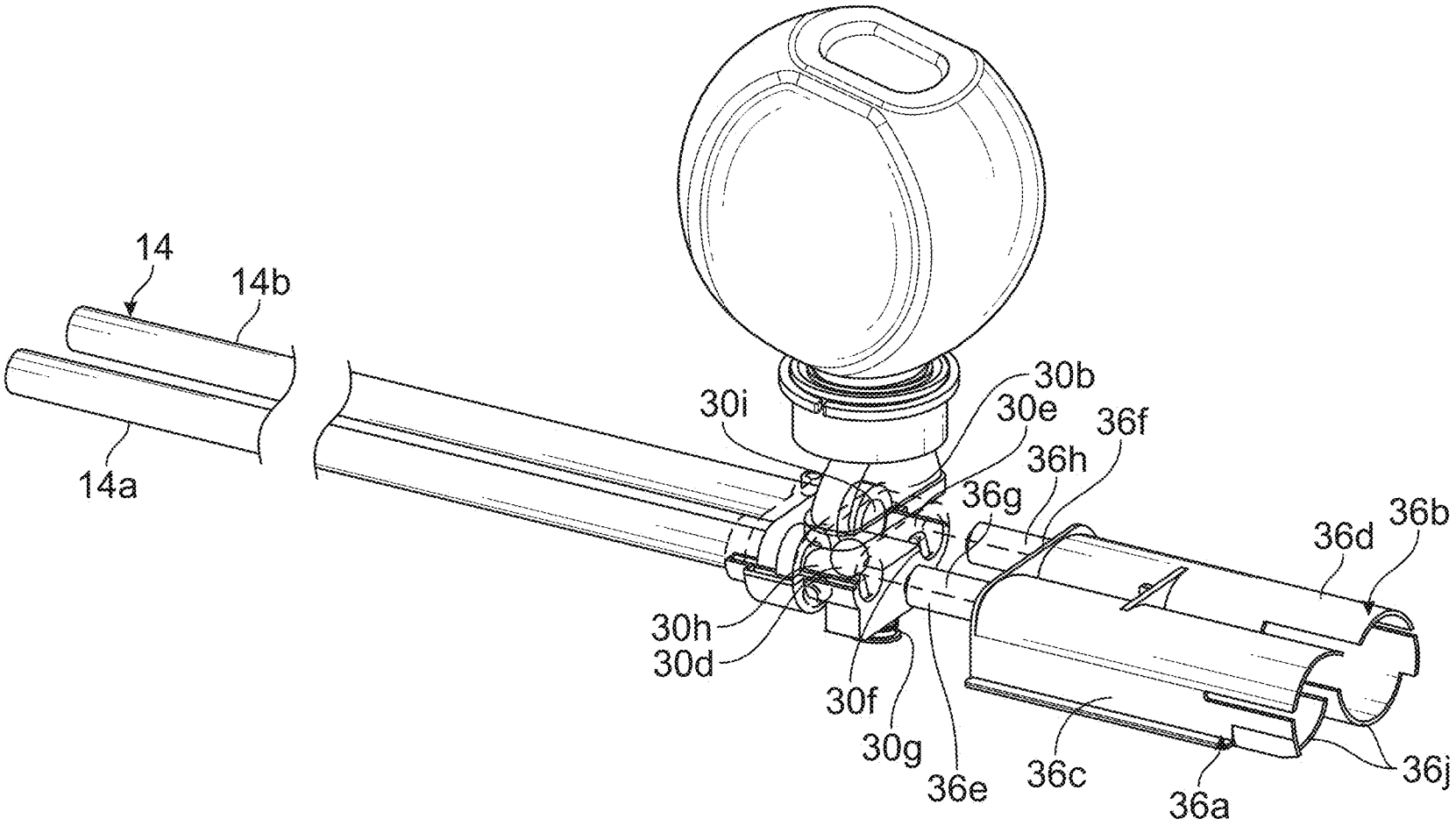
FIG. 3B shows a close up of the breech and air compression element of the internal firing mechanism.
Figure 3C:
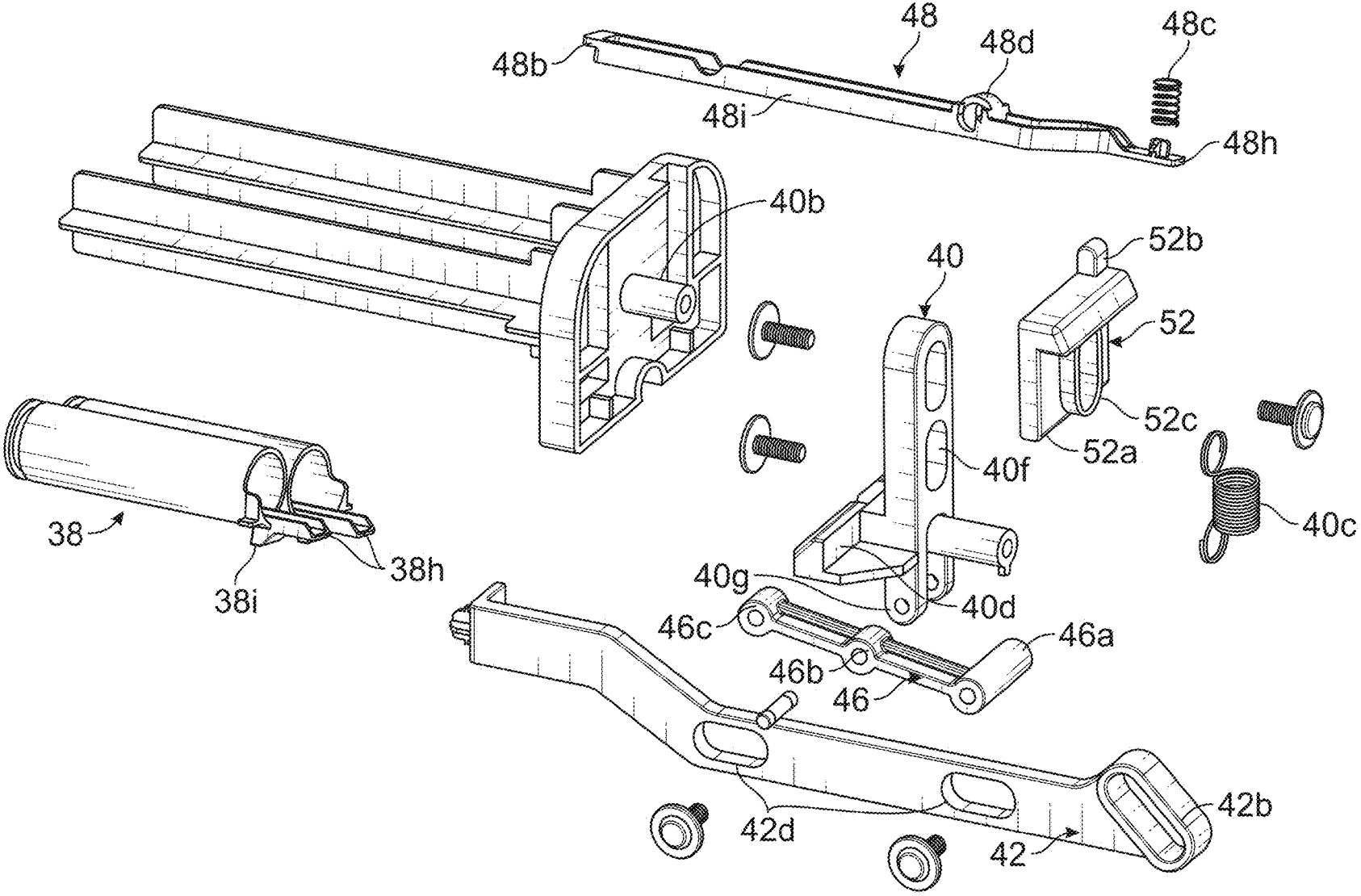
FIG. 3C shows an exploded view of the piston latch and catch mechanism, the mechanism preventing the blaster from firing if the air compression element is not fully advanced and the mechanism preventing the air compression element from retracting once the piston has been primed.

FIGS. 3A and 3B show the main mechanism of the blaster 10. FIG. 3A shows the entire mechanism exploded and FIG. 3B shows a close up of the breech 30 and the air compression element 36. Much of the mechanism is duplicated; the left side of the blaster is a copy of the mechanism on the right side. The purpose of having two copies is to double the number of projectile rounds that are fired at once.

Prior to firing, the projectile rounds are kept in the breech 30. The breech 30 has two alignment passages; the left alignment passage 30*d* and the right alignment passage 30*e*. There are two barrels 14; the left barrel 14*a* and the right barrel 14*b*. The barrels connect to the breech at the barrel seals; the left barrel seal 30*h* couples to the left alignment passage 30*d* and the right barrel seal 30*i* connects to the right alignment passage 30*e*. Projectile rounds enter the alignment passages from the hopper 12 through the hopper channel 30*b* by gravity. Only one projectile round may enter each alignment passage via gravity after each stroke of the priming handle 32.

Projectile rounds are pushed through the barrel seals by the air compression element 36. The air compression element 36 also can expel air through its distal end. The air compression element 36 is constrained to move longitudinally. The air compression element 36 has two chambers: the left air compression element chamber 36*a* and the right air compression element chamber 36*b*. Each air compression element chamber has a cylinder as its main body and a bolt at its distal end. The left air compression element chamber 36*a* has a left cylinder 36*c* and a left bolt 36*e*. The right air compression element chamber 36*b* has a right cylinder 36*d* and a bolt 36*f*. Each bolt has a fluid communication channel for fluid communication between the inside of the chamber and the distal end of its bolt. The left bolt 36*e* has a left fluid communication channel 36*g* and the right bolt 36*f* has a right fluid communication channel 36*h*. The alignment passages receive the bolts; the left alignment passage 30*d* receives the left bolt 36*e* and the right alignment passage 30*e* receives the right bolt 36*f*. When the alignment passages receive the bolts, the one projectile round in each alignment passage goes through the breech seals. Once the bolts have retracted from the alignment passages one more projectile round may enter each alignment passage. If the bolts advance into the breech 30 again, the additional projectile rounds will be pushed through the barrel seals by the bolts. Hence, two strokes will allow the blaster 10 to fire four projectile rounds simultaneously.

The projectile rounds are fired by pneumatic pressure. The pneumatic pressure is provided by the air compression element 36 and the piston 38. The piston 38 is constrained to move longitudinally. The piston 38 has two chambers: the left piston chamber 38*m* and the right piston chamber 38*n*. The left piston chamber 38*m* is slidably received by the left air compression element chamber 36*a*. Likewise, the right piston chamber 38*n* is slidably received by the right air compression element chamber 36*b*. Both piston chambers have a piston cap and an O-ring at their distal end. The left piston chamber 38*m* has a left piston cap 38*e* and a left O-ring 38*k*. Likewise, the right piston chamber 38*n* has a right a right piston cap 38*f* and a right O-ring 38*l*. The piston caps and O-rings provide a pneumatic seal when the piston is received by the air compression element.

The piston has two posts which extend distally: the left piston post 38*a* and right piston post 38*b*. The left piston post 38*a* is slidably received by the left piston chamber 38*n*. Likewise, the right piston post 38*b* is slidably received by the right piston chamber 38*n*. Both piston posts have a piston spring. The left piston post 38*a* has a left spring 38*c* and the right piston post 38*b* has a right spring 38*d*. The piston springs provide a biasing force on the piston and the piston posts stabilize the piston springs.

If the air compression element 36 is advanced and the piston 38 is retracted, the piston springs will be compressed.

Then, if the piston 38 is suddenly released, the air compression element 36 will quickly receive the piston 38. Then the air pressure will rapidly increase within the air compression element 36 and air will be expelled through the fluid communication channels and into the alignment passages. The projectile rounds that have already gone through the barrel seals will then be expelled through the barrels 14.

The priming handle 32 translates the air compression element 36 and the piston 38. The priming handle 32 is coupled with the priming handle conveyor 34 which in turn is connected to the air compression element 36. Moving the priming handle 32 will move the air compression element 36 accordingly.

The air compression element 36 has an air compression element driving coupling 36*j* at its proximal end. Likewise, the piston 38 has a piston driving coupling 38*g* at its proximal end. The air compression element driving coupling 36*j* couples with the with the piston driving coupling 38*g*. Therefore, if the priming handle 32 retracts, the piston 38 will retract as well.

The projectile round positioner 30*f* prevents projectile rounds from exiting the breech through the proximal end of the breech 30 when the bolts are not in the alignment passages. The projectile round positioner spring 30*g* provides a biasing force on the projectile round positioner 30*f*. When the bolts advance into the breech 30, the projectile round positioner 30*f* follows the bolts and the projectile round positioner 30*f* retracts. The bolts then may enter the breech.

FIGS. 3C, 4A, 4B and 4C show the piston lock mechanism that is responsible for preventing the piston 38 from advancing once the piston 38 has retracted and for releasing the piston 38 once the trigger 16 is pulled. Retracting the priming handle 32 will cause the piston 38 to retract and the piston springs to compress. Once the priming handle 32 has advanced the piston 38 will still be retracted and the piston springs will still be compressed. If the trigger 16 is pulled, the piston 38 will be released and will be allowed to advance.

The piston 38 is prevented from advancing once the piston 38 has retracted via a latch and catch mechanism. The distal end of the piston 38 has a piston catch 38*i* and piston cam 38*h*. The piston lock 40 is constrained by the piston lock housing 40*b* at the piston lock constraint follower 40*f* to move vertically. The piston lock 40 has a piston latch 40*d* and a piston lock spring 40*c* to provide a biasing force on the piston lock 40.

As the piston 38 retracts, the piston cam 38*h* contacts the piston latch 40*d*. The piston latch 40*d* follows the piston cam 38*h* and the piston lock 40 translates downward. Once the piston catch 38*i* has moved past the piston latch 40*d*, the piston lock 40 will move upward. At this point, the piston 38 may not advance as the piston catch 38*i* couples with the piston latch 40*d*. Hence, once the piston 38 has retracted far enough, it may not advance until the piston lock 40 releases the piston 38.

Figure 4A:
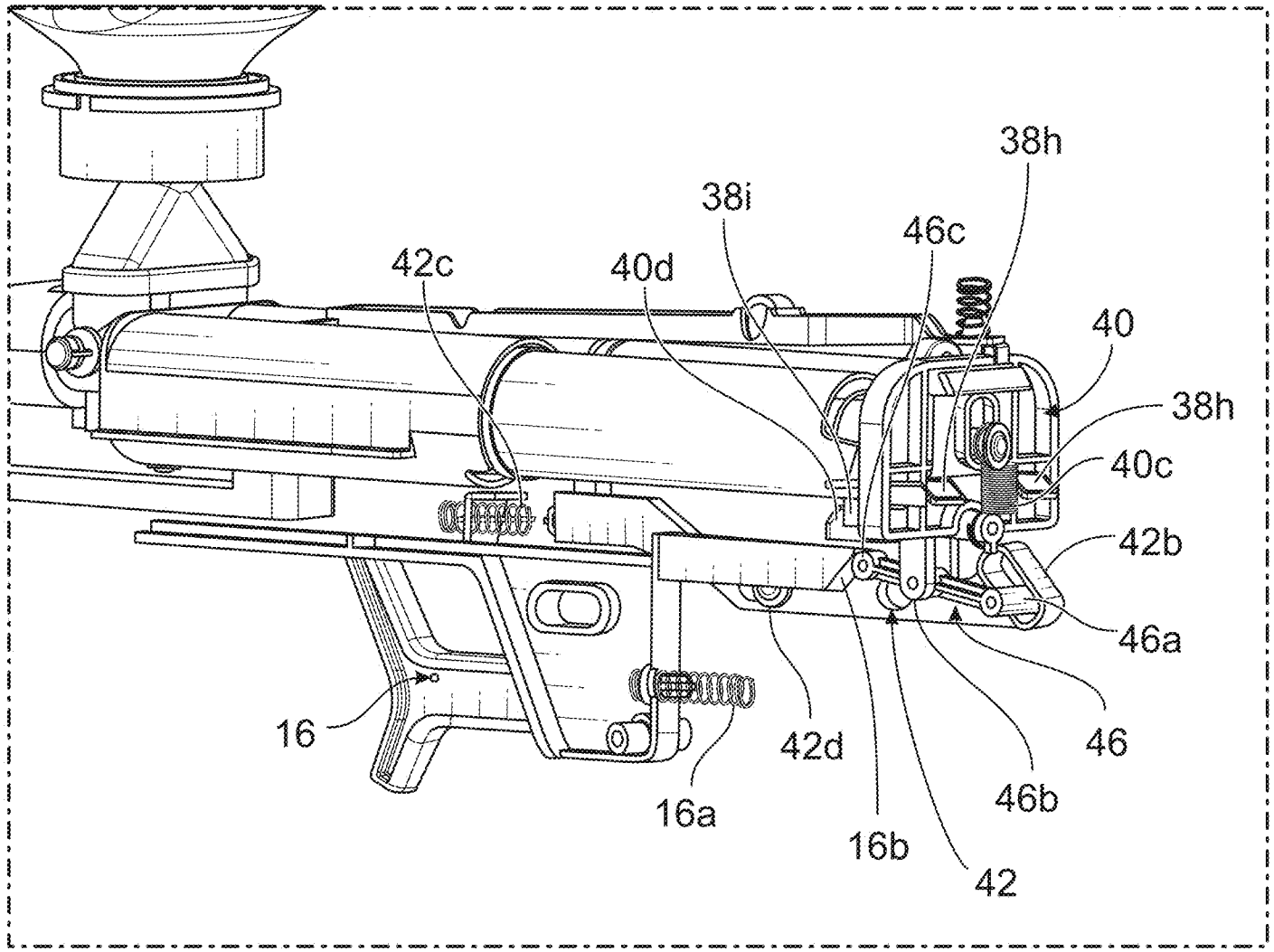
FIGS. 4A, 4B and 4C show the steps involved in preventing the blaster from firing if the air compression element is not fully advanced.

The advanced lock is responsible for releasing the piston 38 when the trigger 16 is pulled when the air compression element 36 is fully advanced. The advanced lock lever 46 is pivoted by the piston lock pivot 40*g* at the advanced lock lever pivot 46*b*. The advanced lock lever 46 may be rotated clockwise facing right, as shown in FIG. 4A or rotated counterclockwise facing right, as shown in FIG. 4C. If the advanced air compression element lock lever 46 is rotated clockwise the advanced lock lever distal follower 46*c* will follow the trigger cam 16*b*. If the trigger 16 retracts, the advanced lock lever 46 will rotate counterclockwise. Since the advanced lock lever proximal follower 46*a* follows the advanced lock cam 42*b*, the moment applied on the advanced lock lever 46 will cause a downward force on the piston lock 40 at the piston lock pivot 40*g*. The piston latch 40*d* will disengage from the piston catch 38*i* and the piston 38 will be released.

Figure 4B:
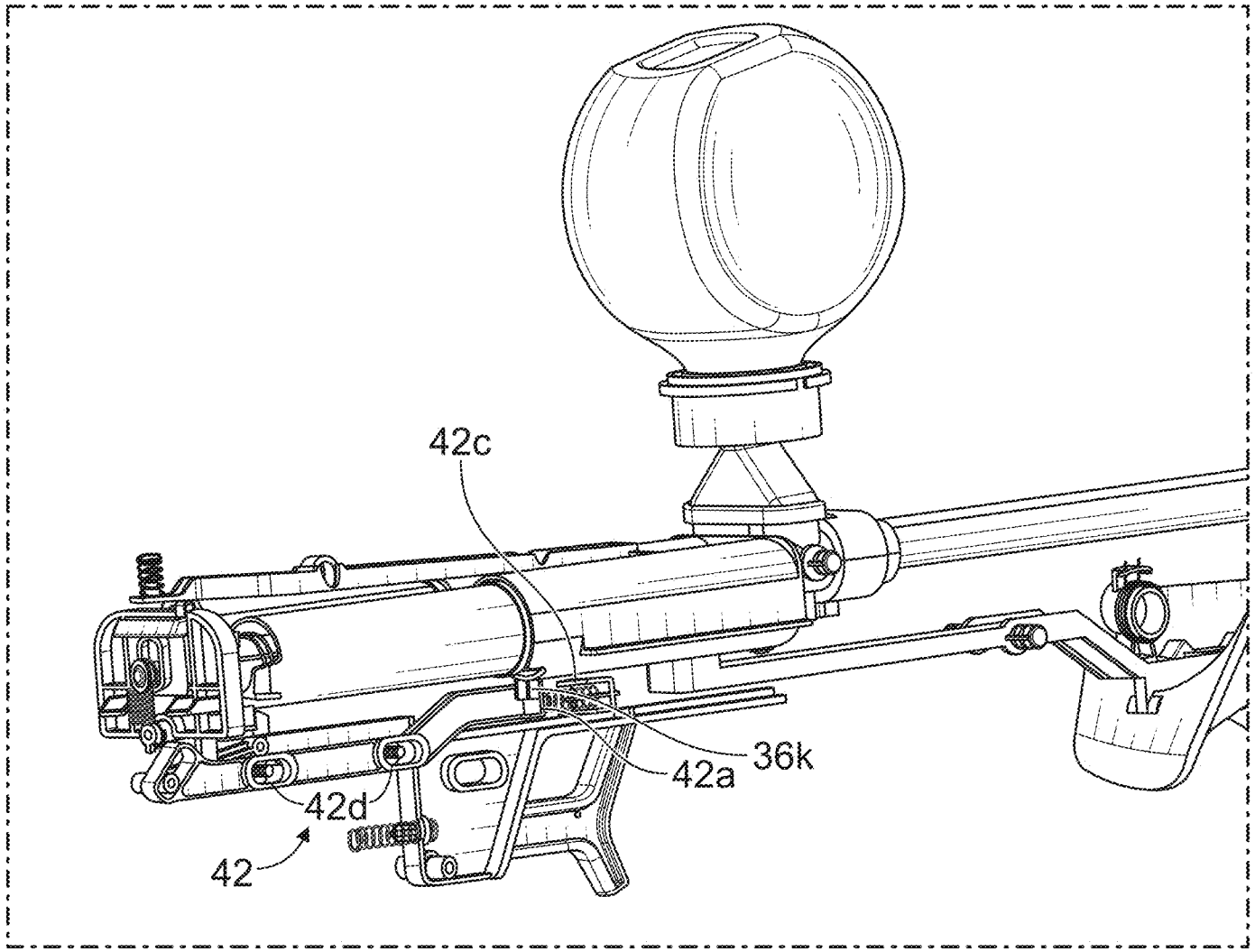
Figure 4C:
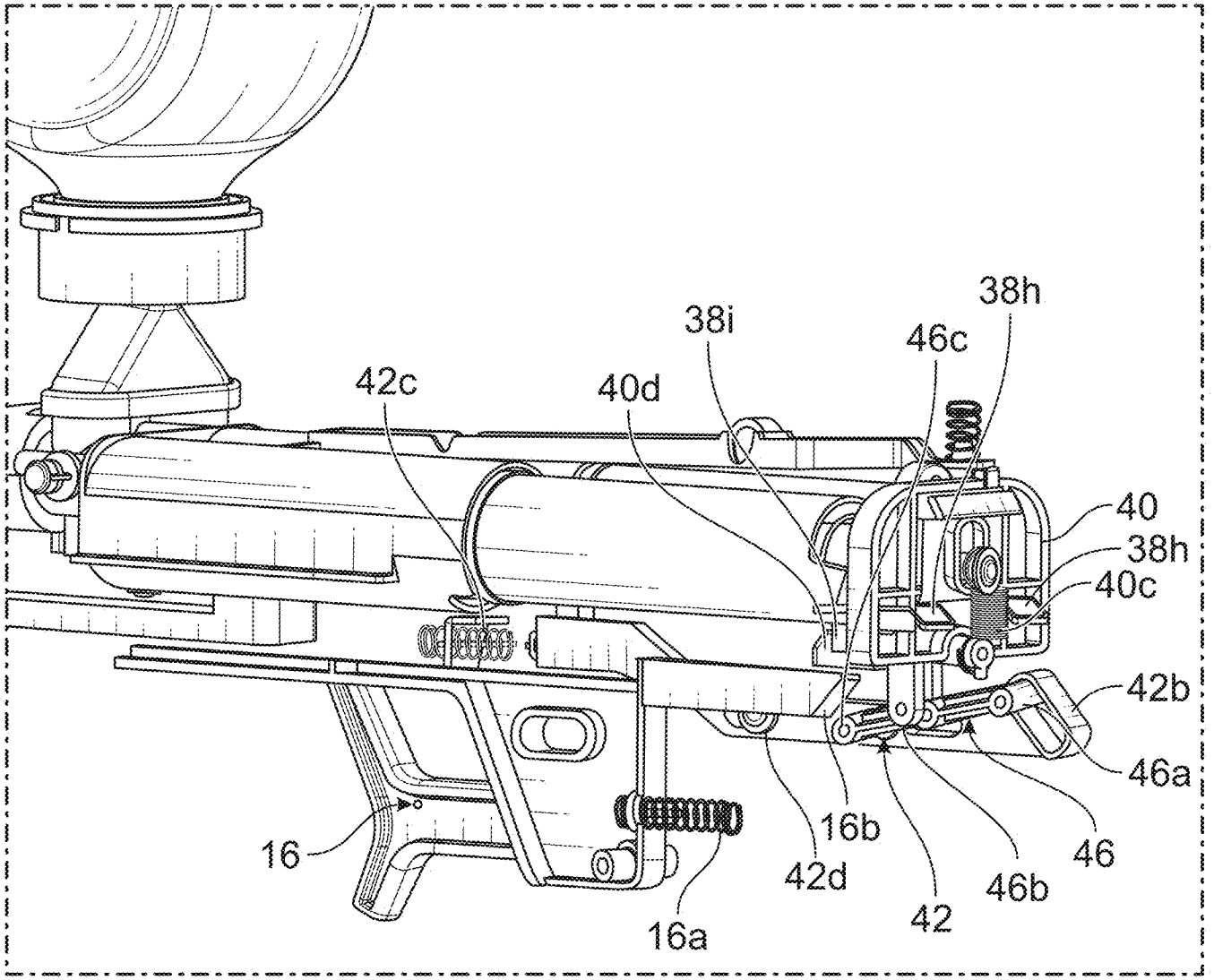

As shown in FIG. 4B, if the air compression element 36 has retracted slightly the advanced lock 42 will also retract. The advanced lock is constrained to move longitudinally at the advanced lock constraint follower 42*d*. The advanced lock follower 42*a* follows the air compression element cam 36*k*. The advanced lock spring 42*c* provides a biasing force. If the advanced lock 42 retracts, then the advanced lock lever 46 will rotate counterclockwise. As shown in FIG. 4C, the advanced lock lever follower 46*a* follows the advanced lock cam 42*b*. If the advanced lock lever 46 rotates counterclockwise then when the trigger 16 is pulled the trigger cam 16*b* will not contact the advanced lock lever 46. Hence, this piston latch 40*d* will disengage from the piston catch 38*i* and the piston 38 will be released.

Figure 5A:
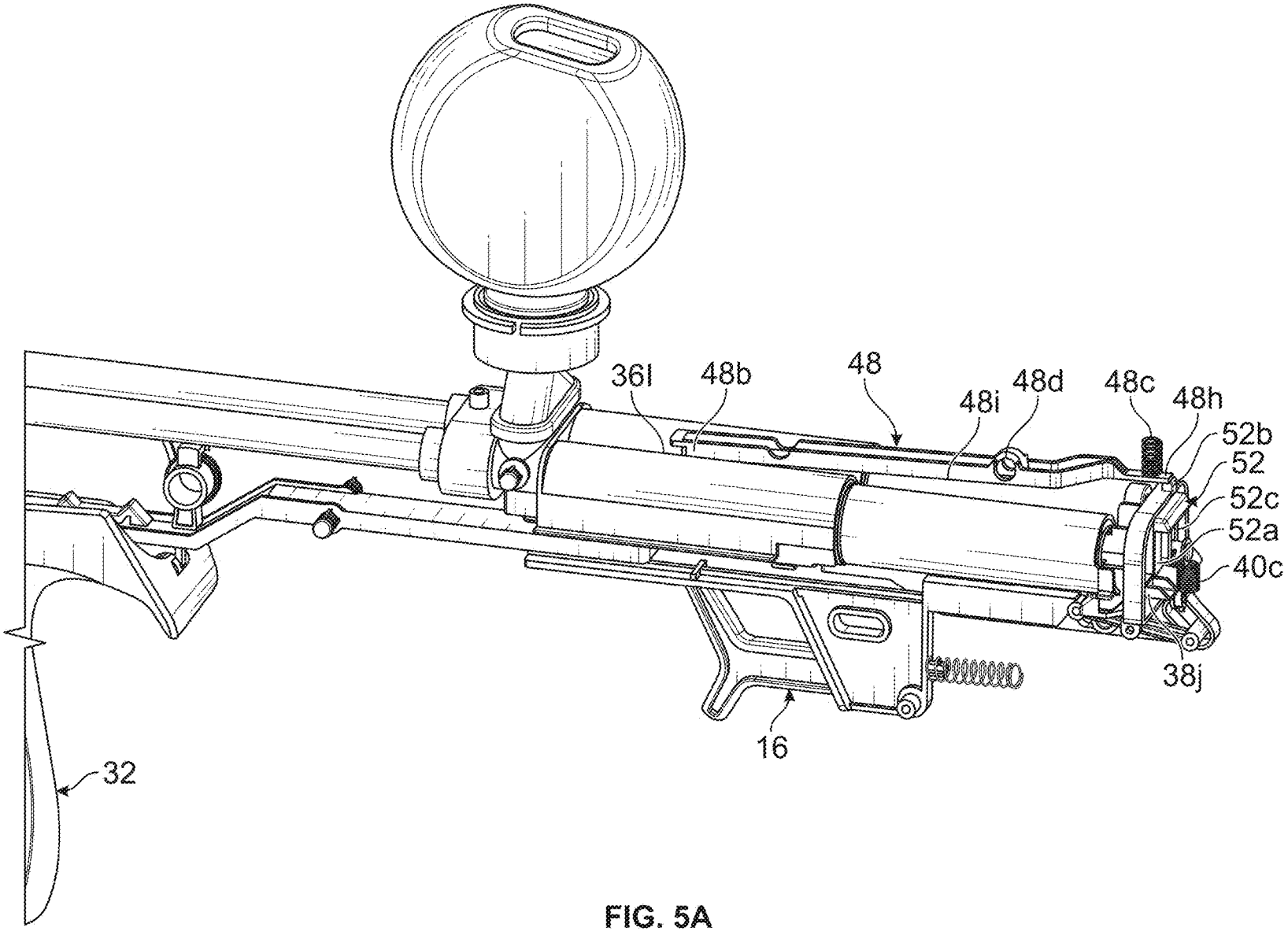
FIGS. 5A and 5B. show an isometric view of the mechanism preventing the air compression element from retracting once the piston has been primed in the lock and catch mechanism and the air compression element has fully advanced.
Figure 5B:
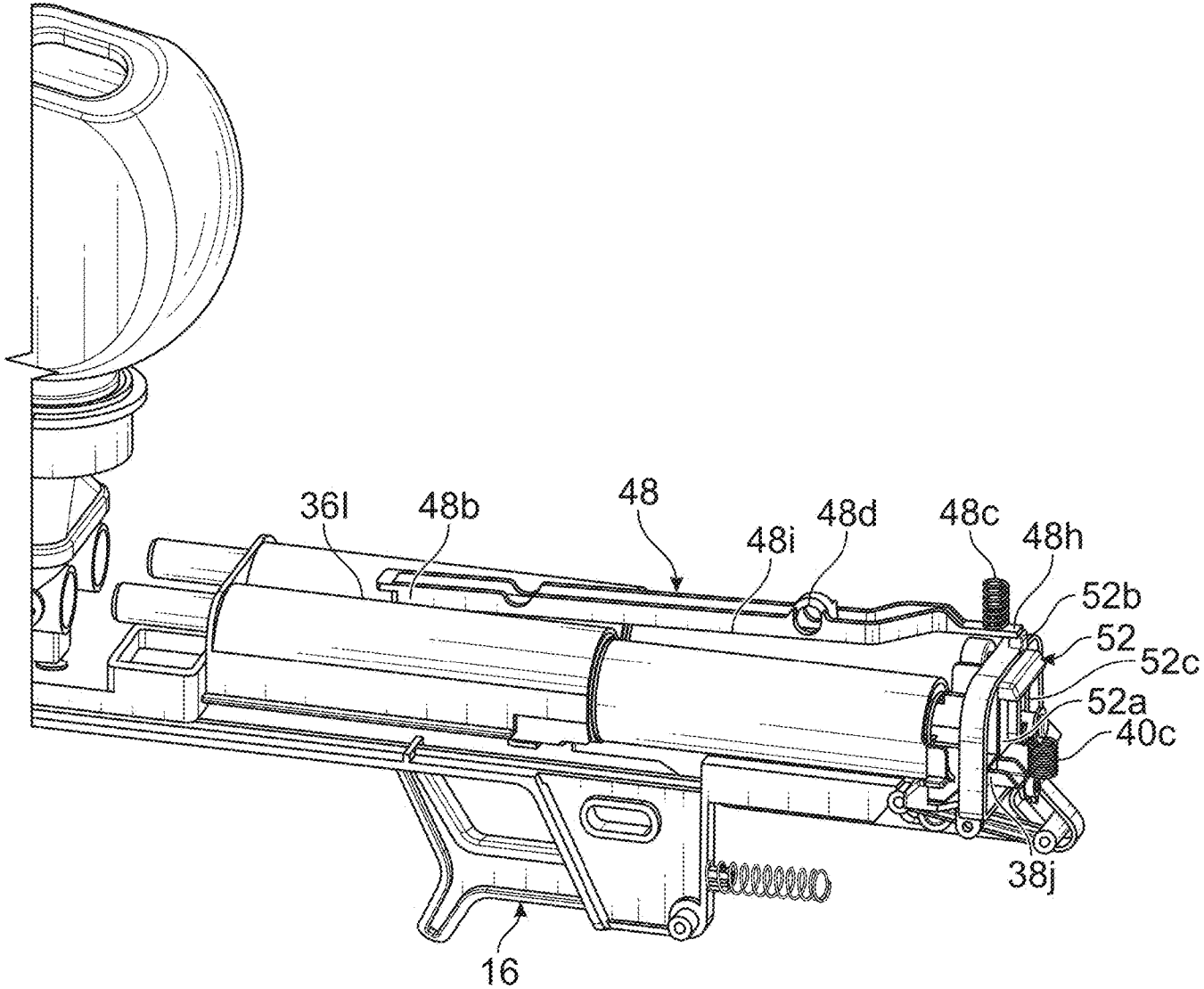

FIGS. 5A and 5B show the retraction lock. The retraction lock prevents the air compression element from retracting after the priming handle 32 has fully retracted and advanced until the trigger 16 has been pulled. The retraction lock slider 52 is constrained to move vertically by the piston latch housing 40*b* and the retraction slider constraint follower 52*c*. The retraction lock slider 52 has a retraction lock slider follower 52*a*. When the piston has retracted, the retraction lock slider follower 52*a* will follow the piston cam 38*j* and the retraction lock slider 52 will translate upward. The retraction lock slider coupling 52*b* couples with the retraction lock lever coupling 48*h*. The retraction lock spring 48*c* provides a biasing force on the retraction lock slider 52 and the retraction lock lever 48. Therefore, if the piston 38 is not retracted then the retraction lock lever 48 will rotate clockwise.

If the piston 38 has retracted, a counterclockwise moment will be applied on the retraction lock lever 48. The retraction lock lever 48 will bend and the retraction lock lever distal follower 48*i* will engage with the retraction catch 36*l*. Once the air compression element 36 is fully advanced, the retraction lock latch 36*l* will be distal of the retraction lock latch 48*b*. The retraction lock lever 48 will straighten and the retraction lock latch 48*b* will engage with the retraction catch 36*l*. Therefore, the air compression element 36 will not be able to retract until the trigger 16 is pulled.

Figure 6:
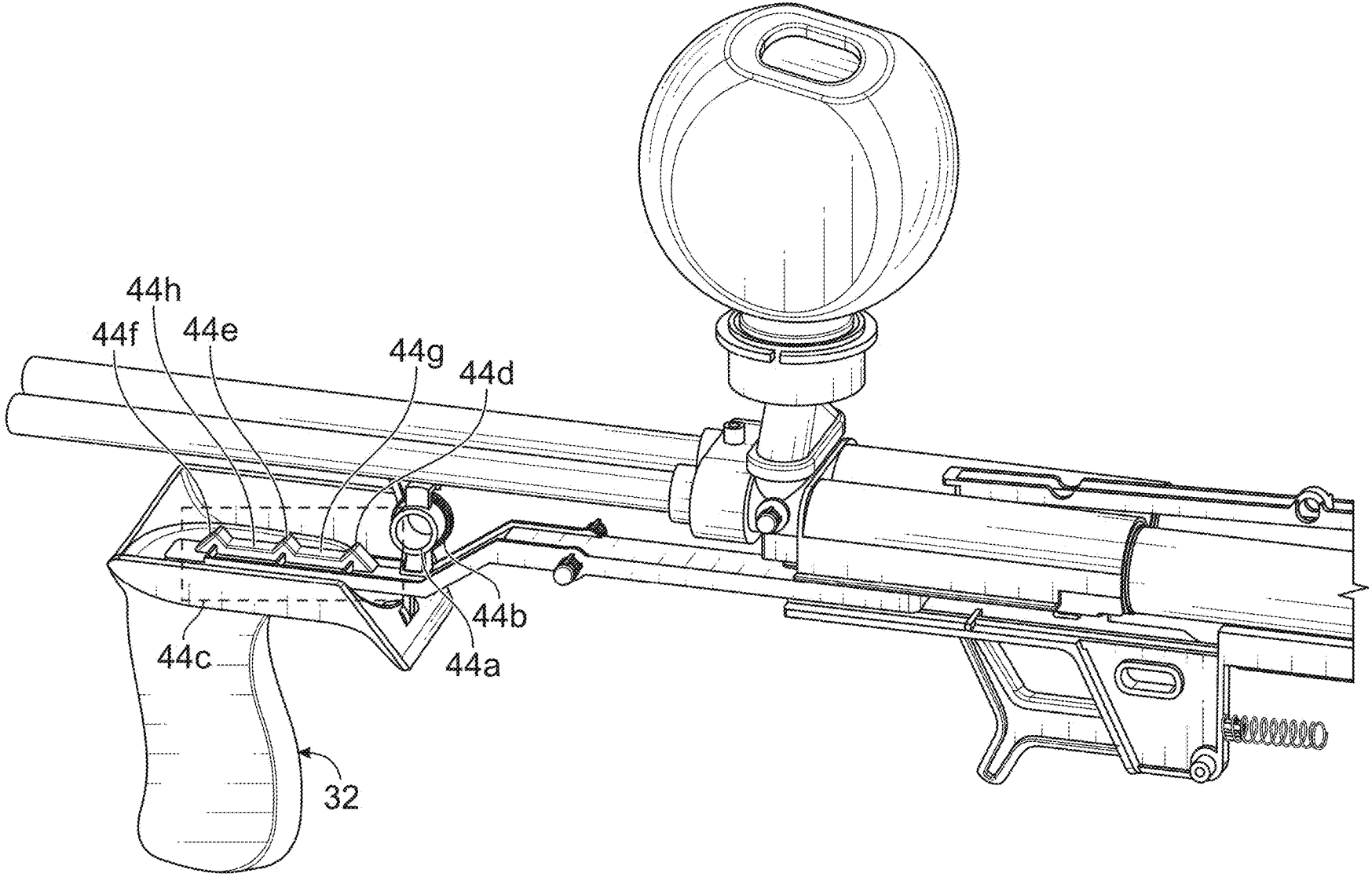
FIGS. 6 and 7 show the interlock and pathway responsible for preventing the blaster from retracting once it has started advancing until it has fully advanced and advancing once it has started retracting until it has fully retracted.

FIG. 6 shows the priming handle lock mechanism. The priming handle lock mechanism prevents the priming handle 32 from advancing before the priming handle 32 fully retracts. The priming handle lock mechanism consists of the priming handle interlock 44*a*, the priming handle interlock follower pathway 44*c* and the priming handle interlock spring 44*b*. The priming handle interlock 44*a* follows the priming handle interlock follower pathway 44*c*. The priming handle interlock spring 44*b* provides a biasing force on the priming handle interlock 44*a*.

Figure 7:
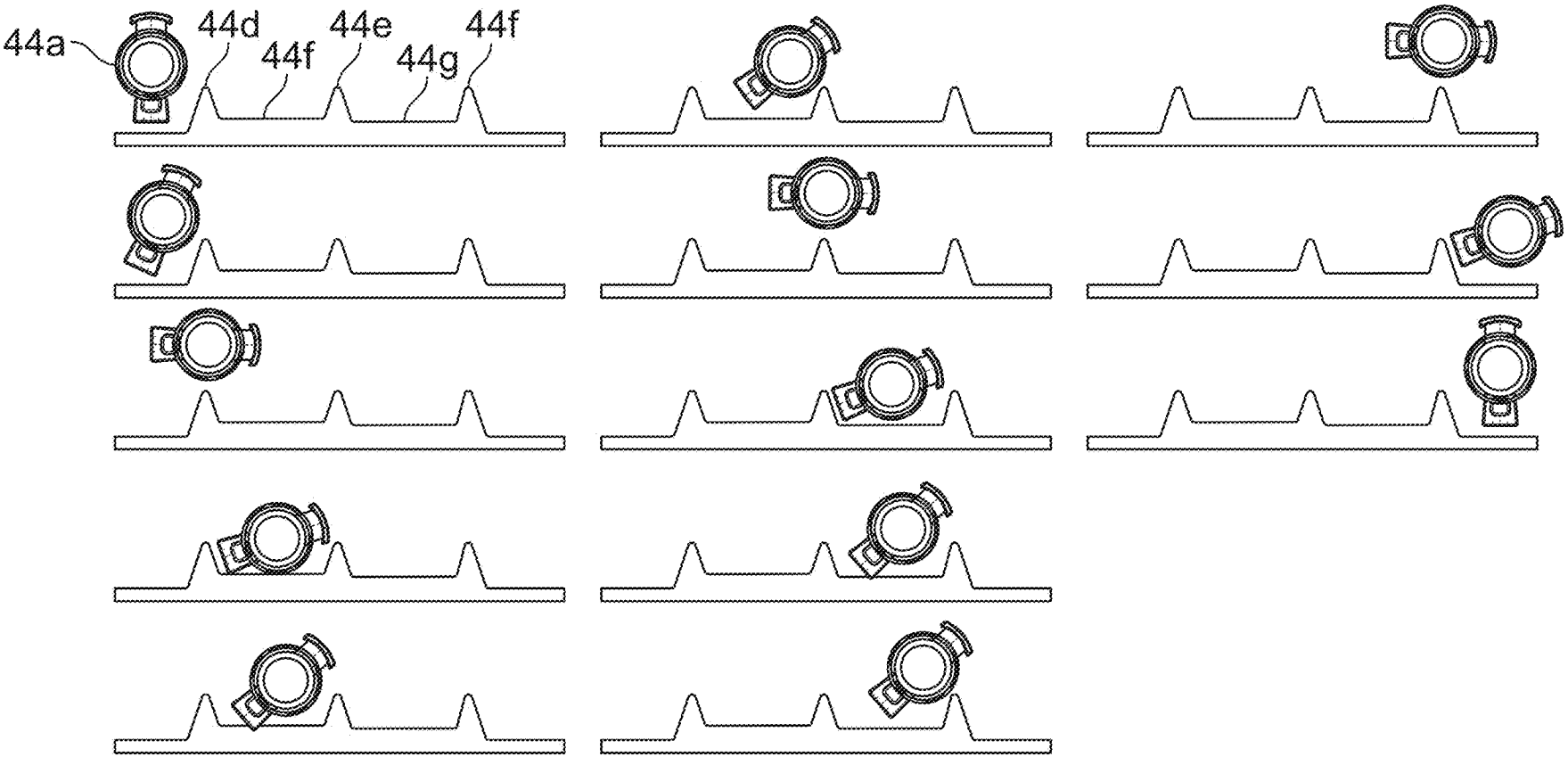

FIG. 7 shows the steps of the priming handle interlock 44*a* following the priming handle interlock follower pathway 44*c*. First, the priming handle interlock 44*a* is fully vertical. As the priming handle 32 retracts, the priming handle interlock 44*a* rotates to go over the first protrusion 44*d*. Once the priming handle has gone over the first protrusion 44*d*, the priming handle interlock 44*a* rotates back. However, since the first engagement surface 44*f* is raised, the priming handle interlock 44*a* does not unrotate fully. Therefore, the bottom face of the priming handle interlock 44*a* is perpendicular to the inside surface of the first protrusion 44*d*. As such, the priming handle 32 is prevented from advancing. If the priming handle 32 retracts further, the priming handle interlock 44*a* will rotate to travel over the second protrusion 44*e*. The same process repeats with the third protrusion 44*f* and the second engagement surface 44*h*. Once, the priming handle 32 is fully retracted, the priming handle interlock 44*a* will have gone over the third protrusion 44*f* and, the priming handle interlock 44*a* will be fully vertical. The same process may repeat but in the other direction for advancing the priming handle 32. Hence, once the priming handle has fully retracted it may begin to advance.

Figure 8:
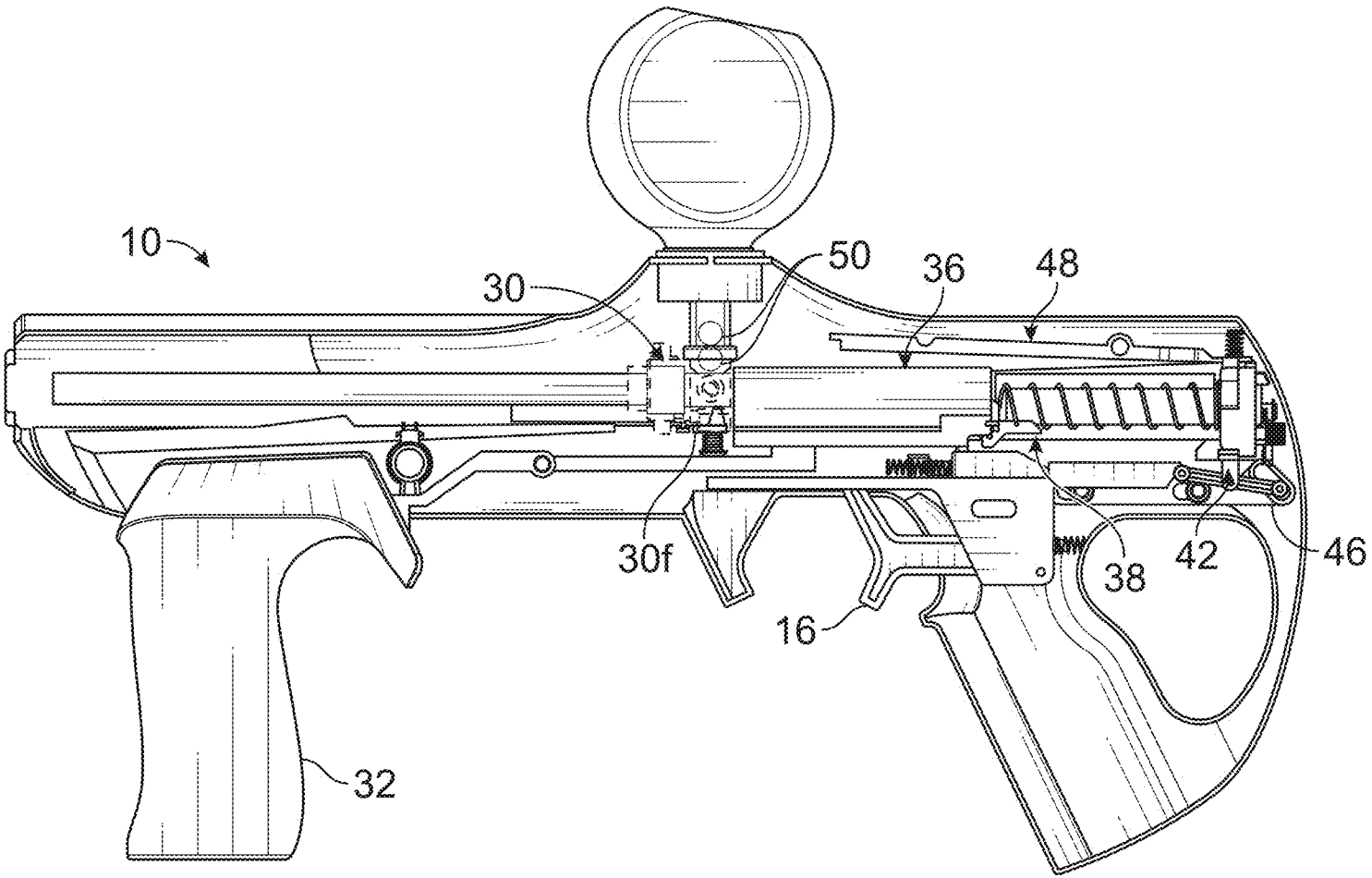
FIGS. 8 through 11 in sequence show the blaster embodiment in side-elevation firing mechanism sectional views.
Figure 9:
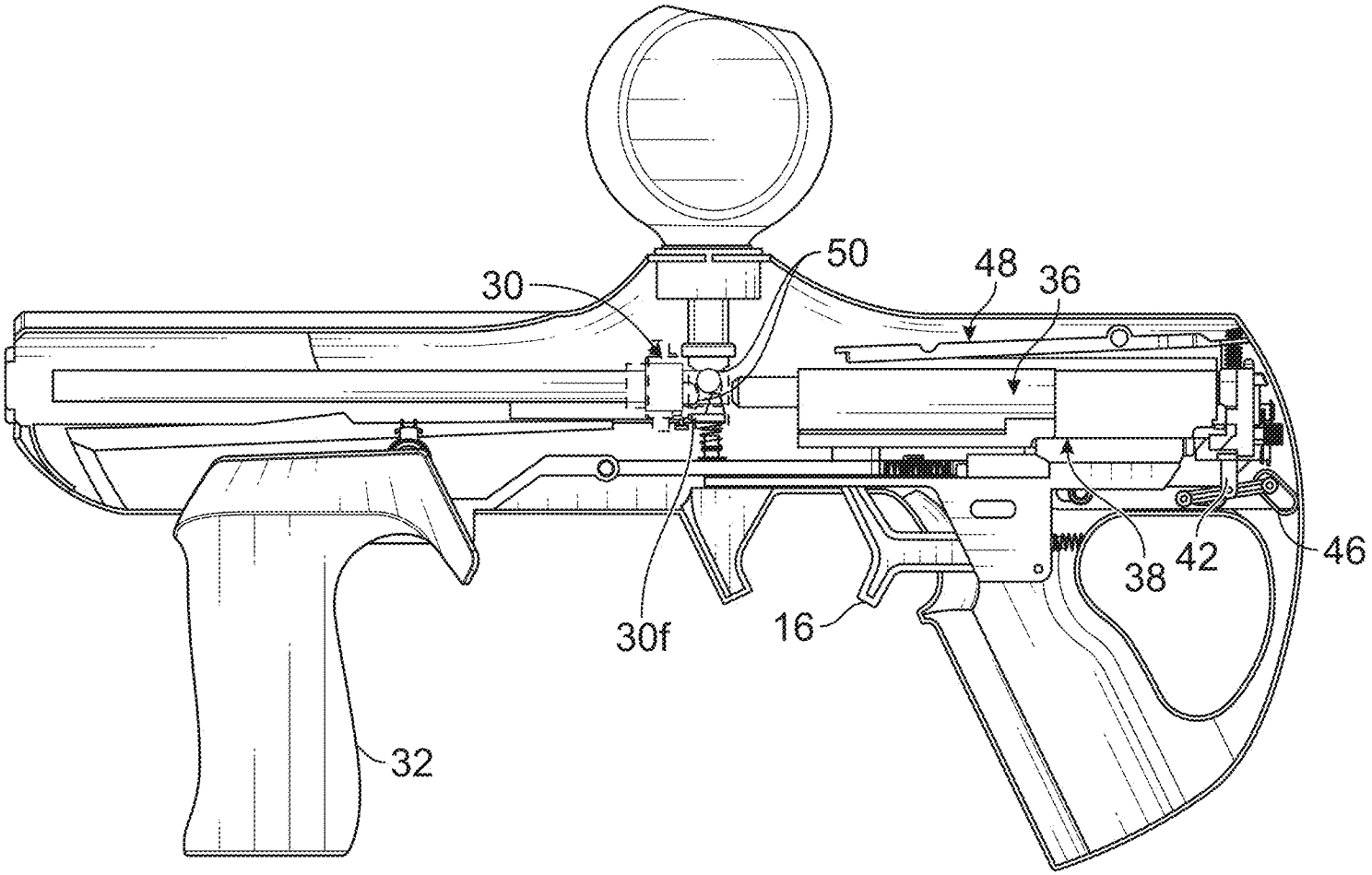
Figure 10:
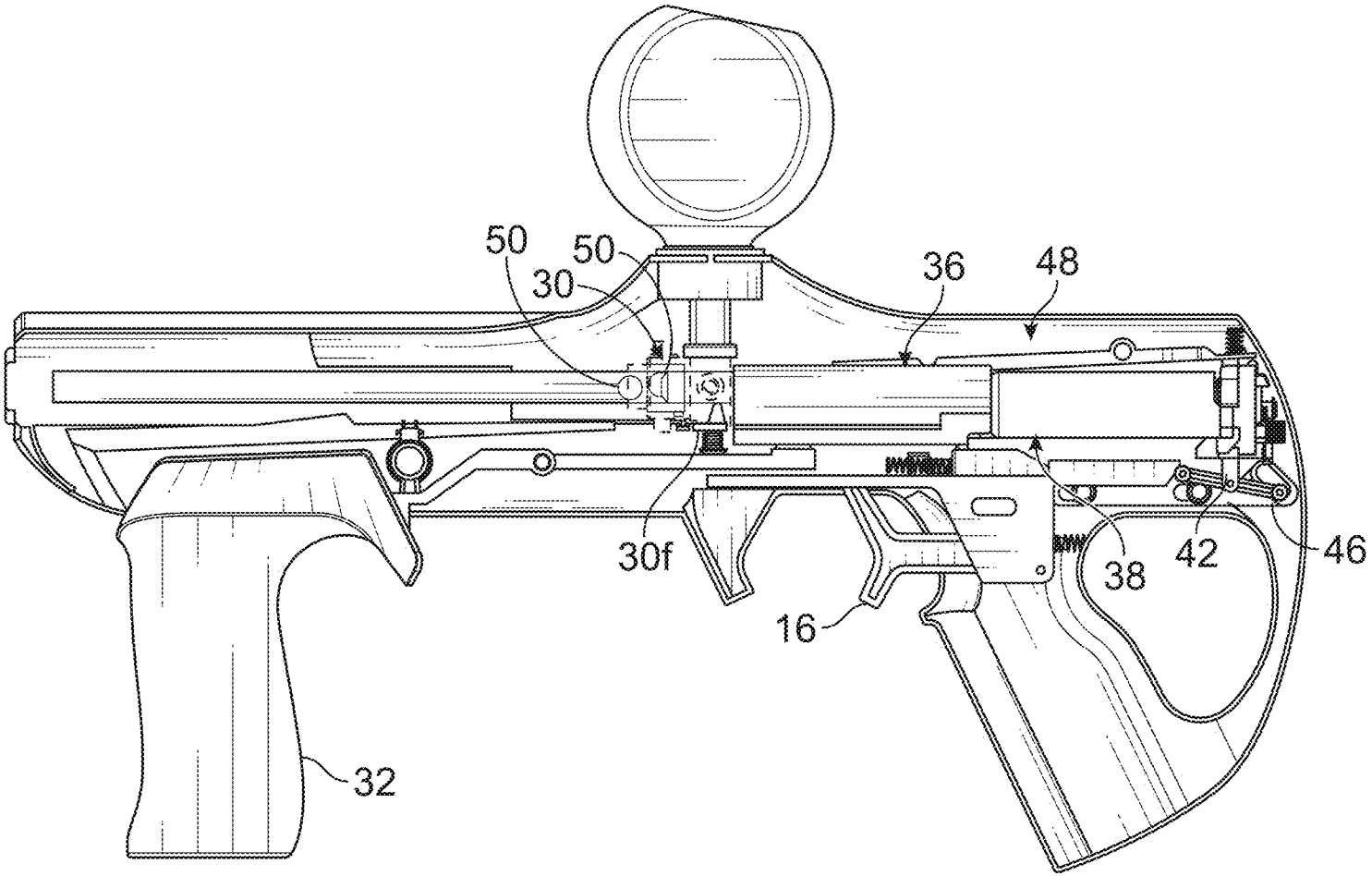
Figure 11:
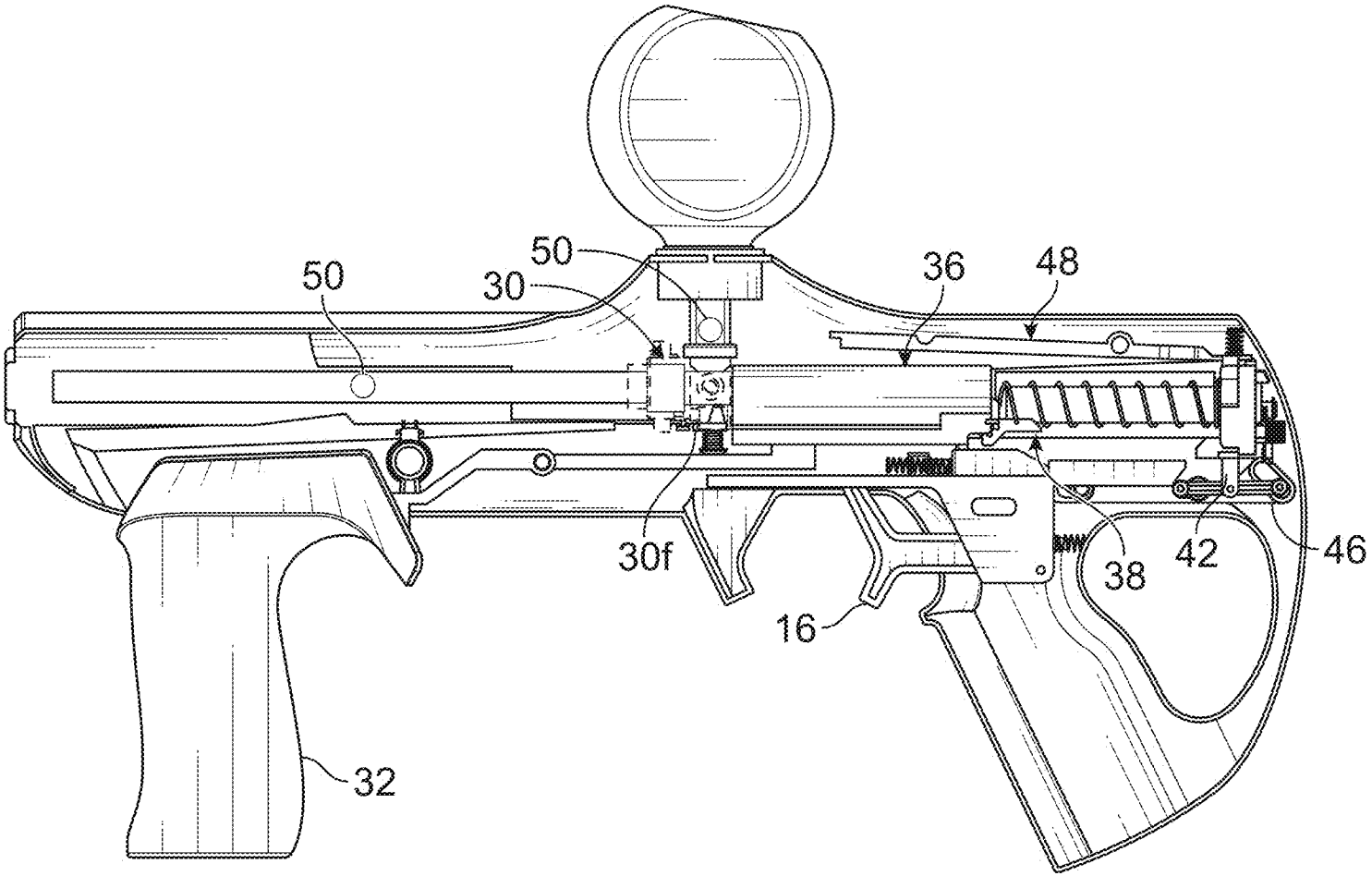

FIGS. 8, 9, 10 and 11 show the steps involved in firing the blaster 10. FIG. 8 shows the priming handle 32 fully advanced. In FIG. 9, the priming handle 32 retracts; the air compression element 36 and piston 38 also retract. The piston catch 38*i* engages with the piston latch 40*d*. The projectile round positioner advances into the breech to prevent the projectile rounds from exiting the proximal end of the breech. Up to one projectile round 50 enters each alignment passage. Next in FIG. 10, the priming handle 32 advances. The piston catch 38*i* is still engaged with the piston latch 40*d*. Hence, the piston 38 is still retracted. However, the air compression element 36 has advanced and the bolts have been received by the alignment passages. The projectile round positioner retracts from the breech to allow the bolts to enter the alignment passages. The projectile rounds 50 are pushed into the barrels forming seals therewith. The advanced lock 42 allows the trigger 16 to releasing the piston 38. Finally in FIG. 12, the trigger 16 is pulled. This causes the piston latch 40*a* to disengage with the piston catch 38*i*. The piston 38 is quickly received by the air compression element 36 and the projectile rounds 50 are fired.

Figure 12A:
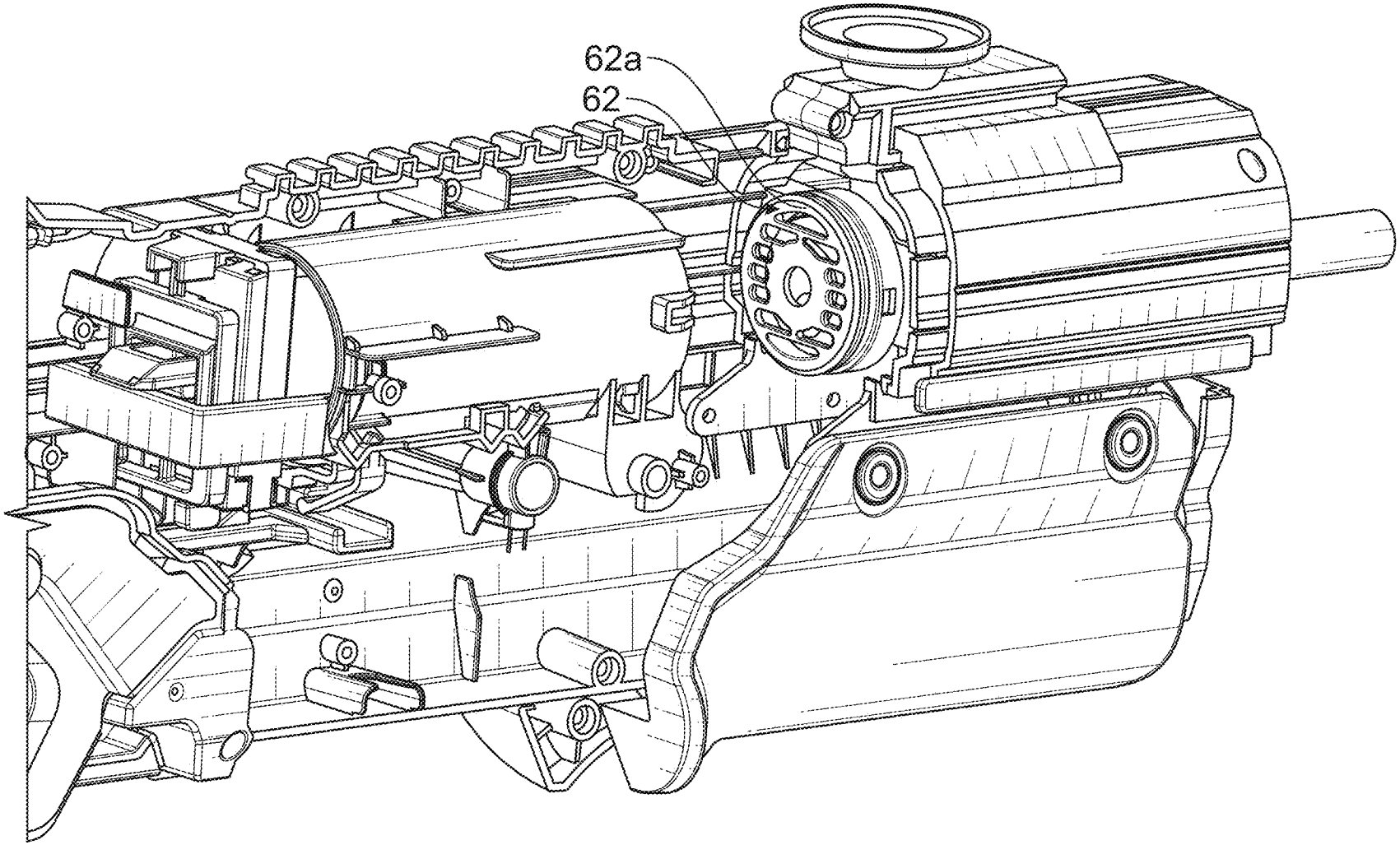
FIGS. 12A and 12B show a second embodiment having no breech bolts and a screen to prevent projectile rounds from exiting the proximal end of the breech.
Figure 12B:
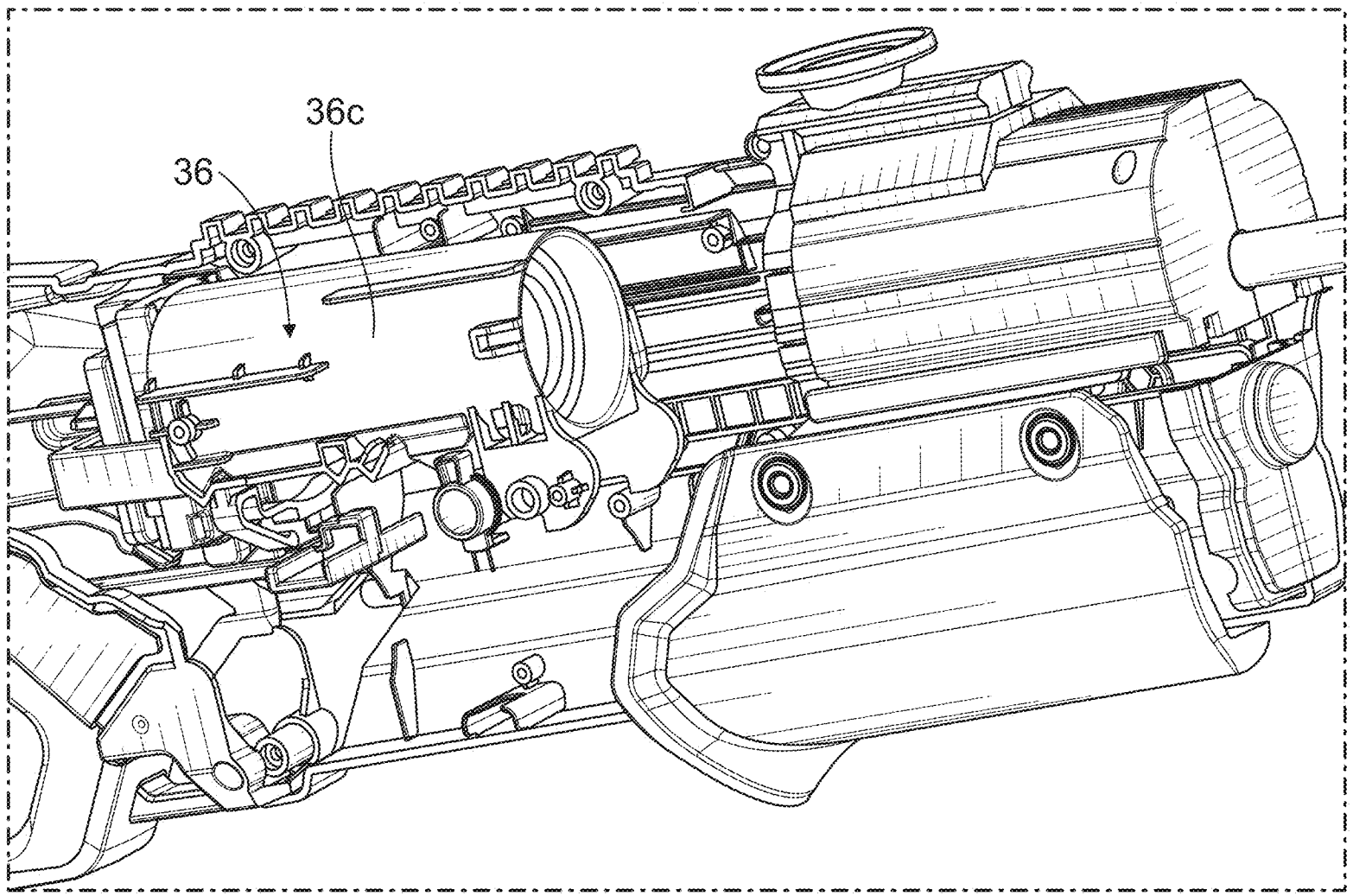

FIGS. 12A and 12B show an alternative mechanism to the projectile round positioner. FIG. 12A shows the breech having an air compression element channel 62. The air compression element channel is covered by the screen 62*a*. The screen 62*a* prevents projectile rounds from exiting through the air compression element channel 62. FIG. 12B shows that the air compression element 36 has no bolts. Instead, the air compression element channel receives the distal end of the air compression element 36. When the piston quickly advances, air is expelled into the breech through the distal end of the cylinder 36*c*.

Figure 13A:
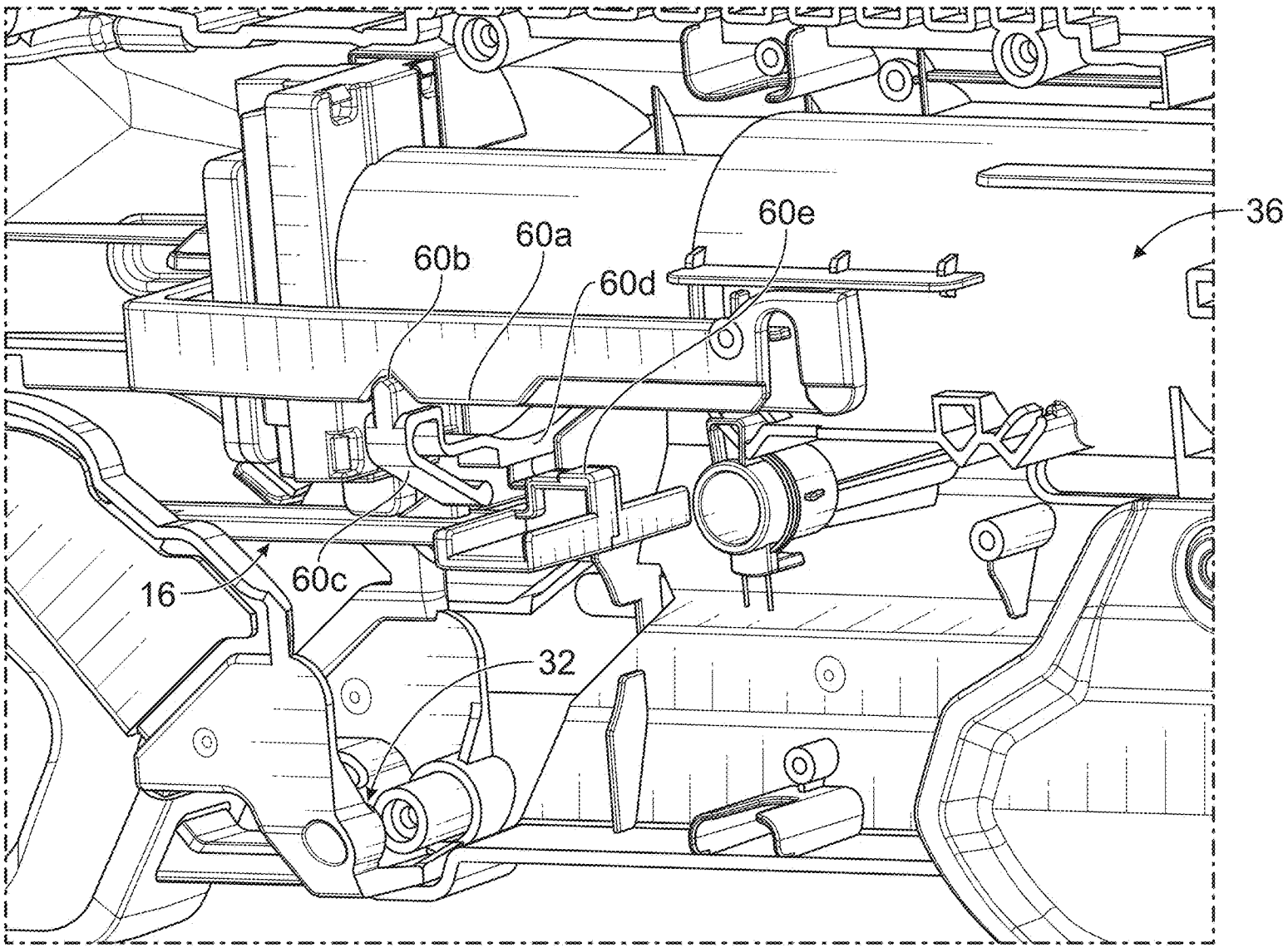
FIGS. 13A and 13B show an alternative mechanism for preventing the blaster from firing when the air compression element is not fully advanced.
Figure 13B:
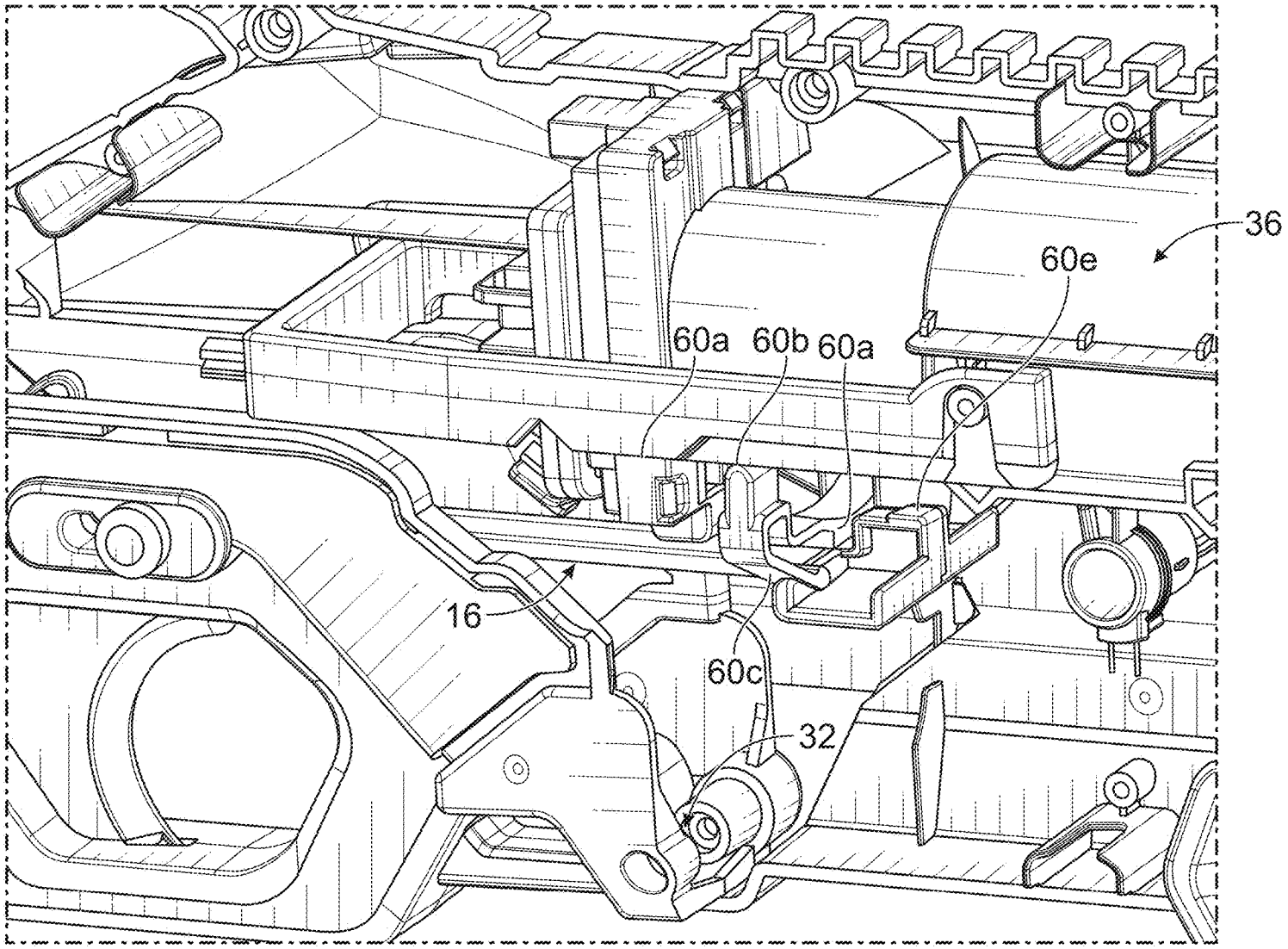
Figure 14:
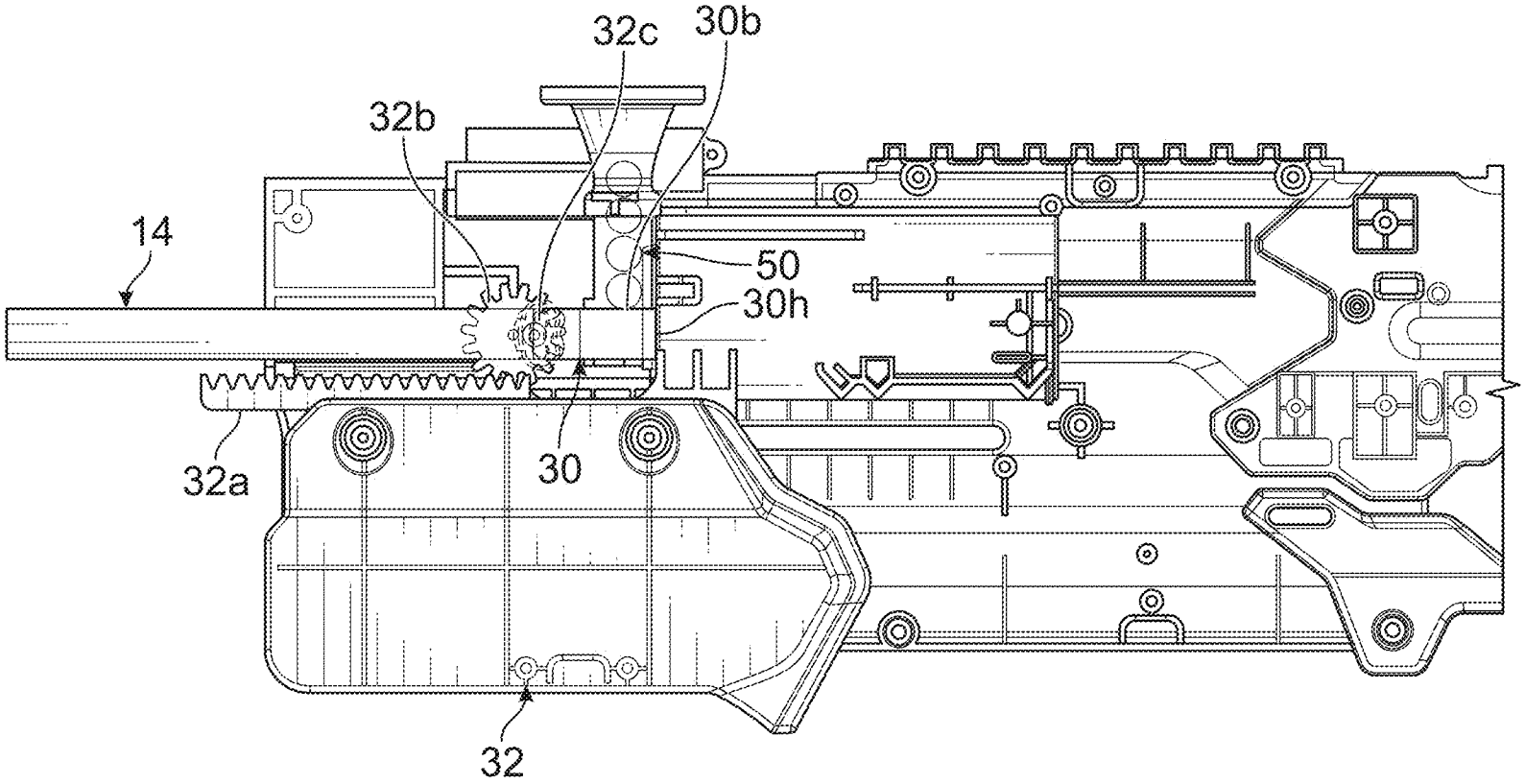
FIGS. 14, 15, 16, 17 and 18 in sequence show an alternative mechanism for positioning projectile rounds in a side elevation sectional view. The barrel, rather than a breech, moves to position projectile rounds.
Figure 15:
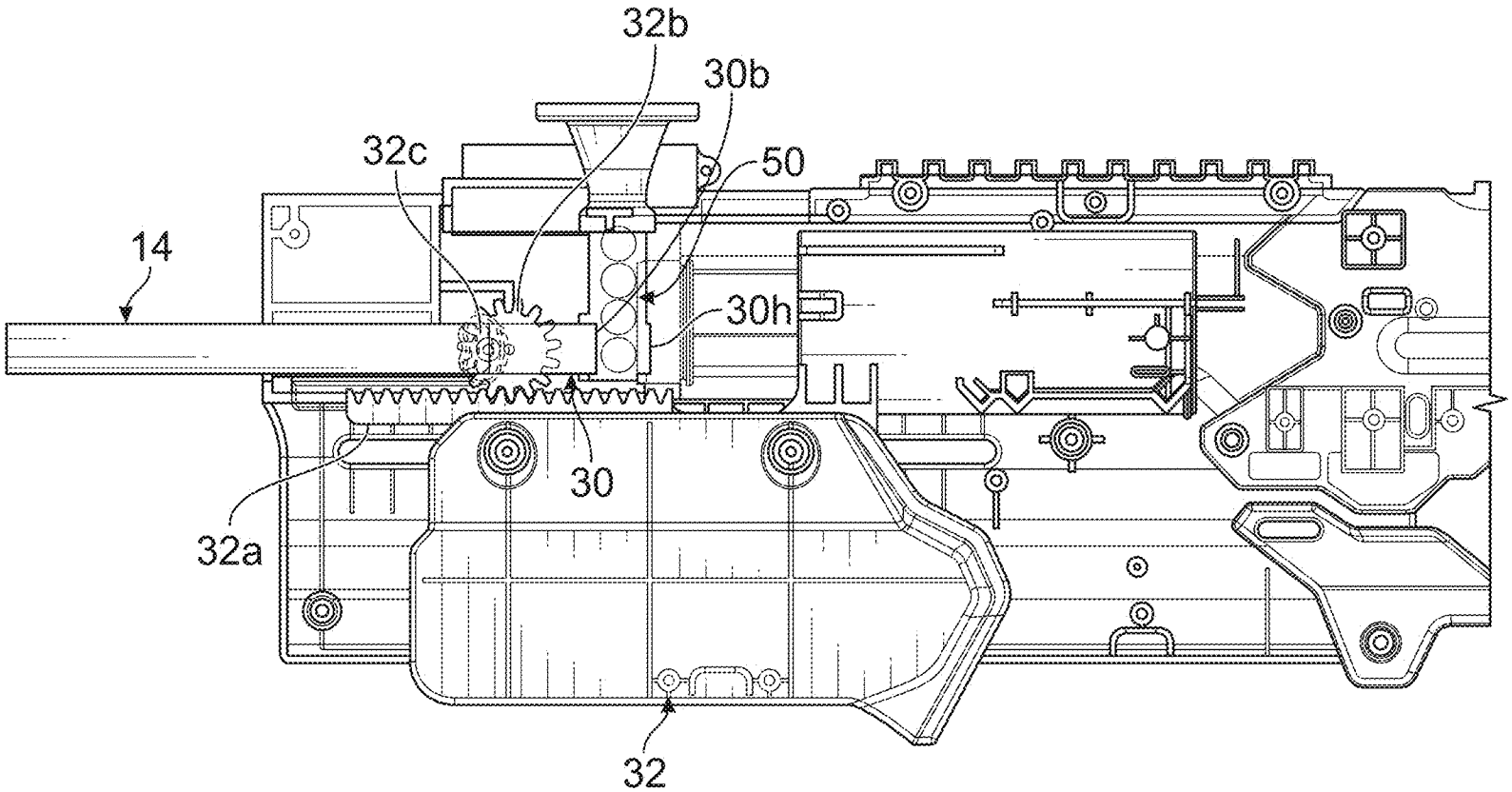
Figure 16:
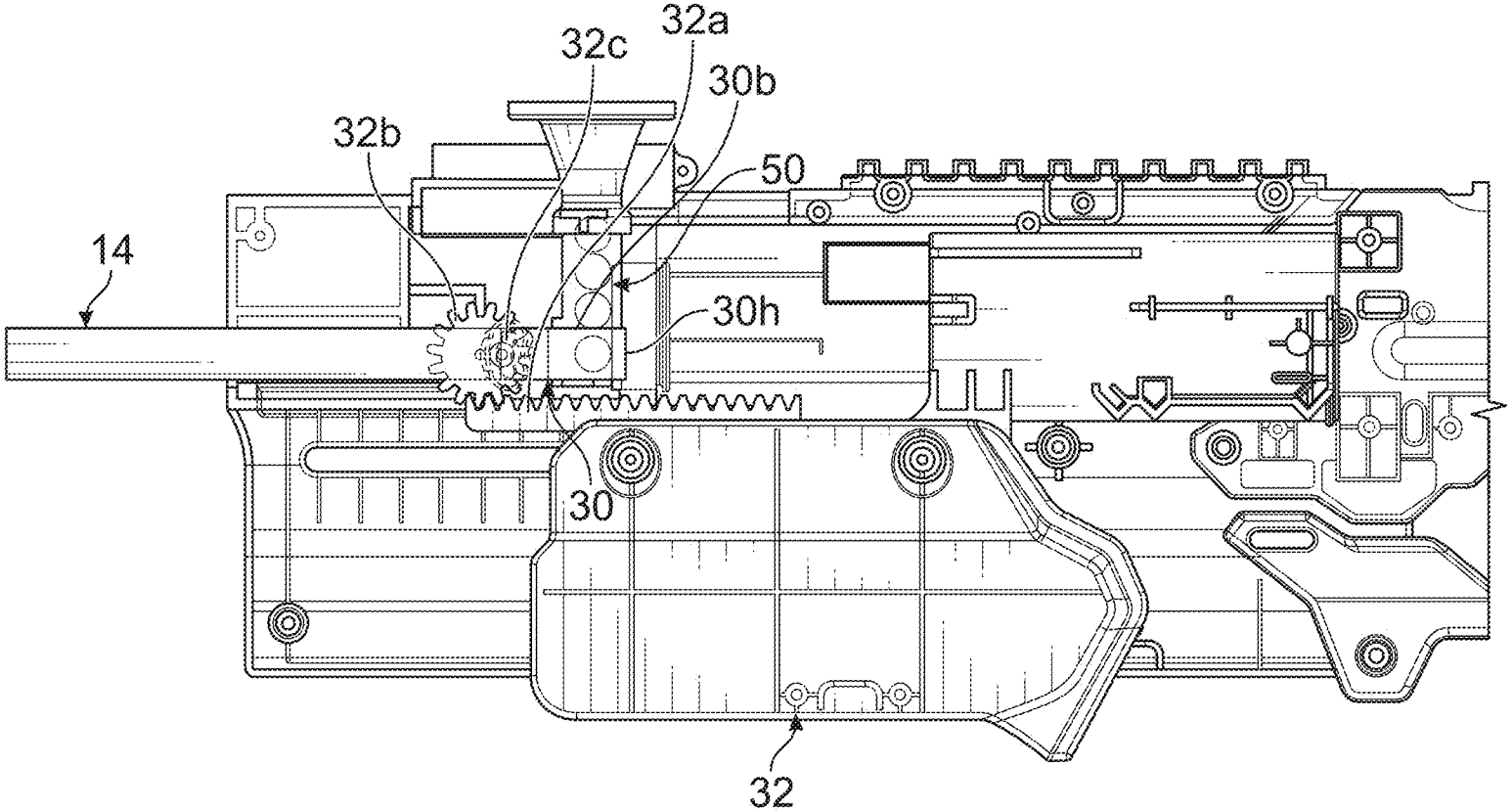
Figure 17:
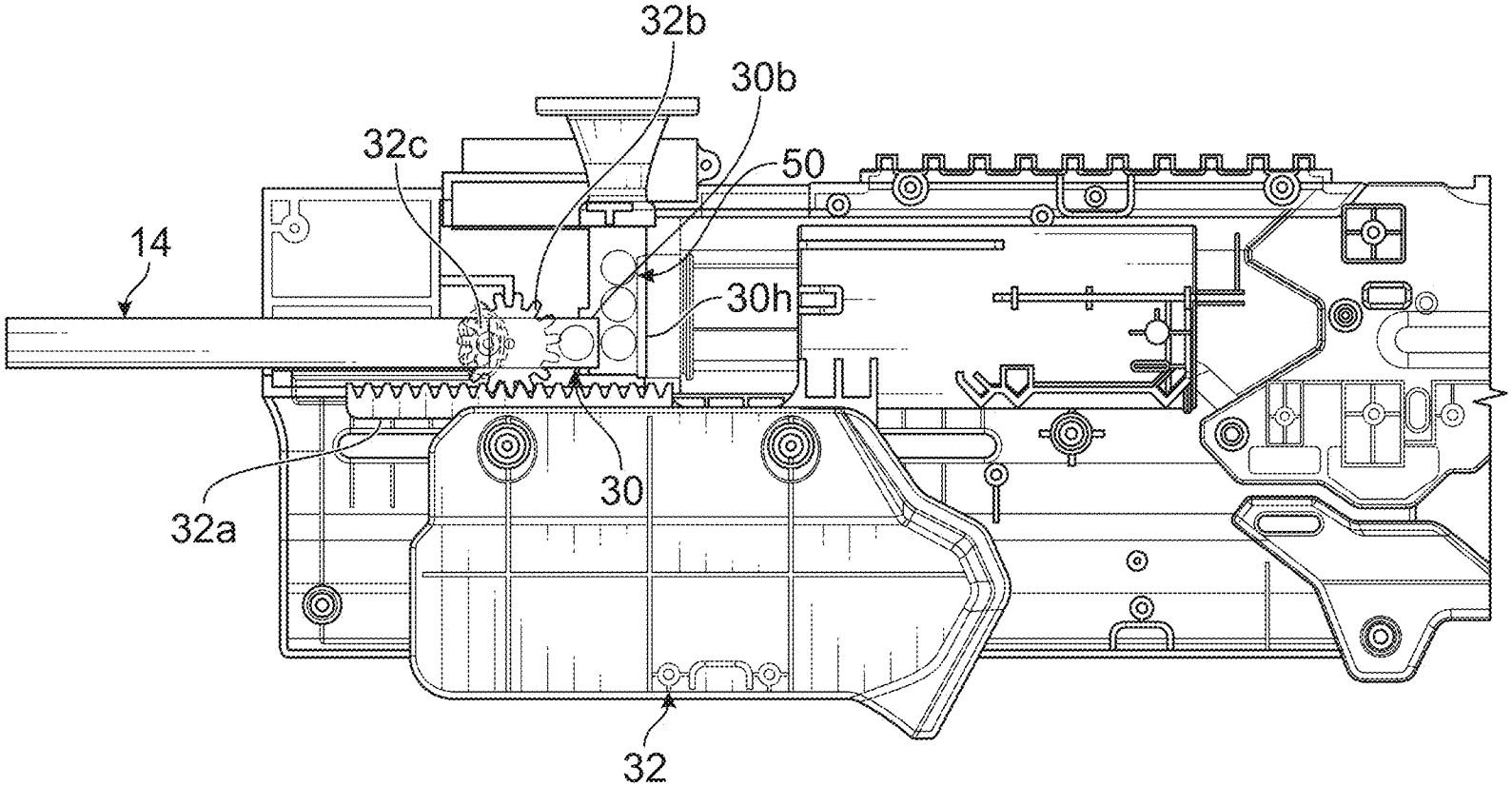
Figure 18:
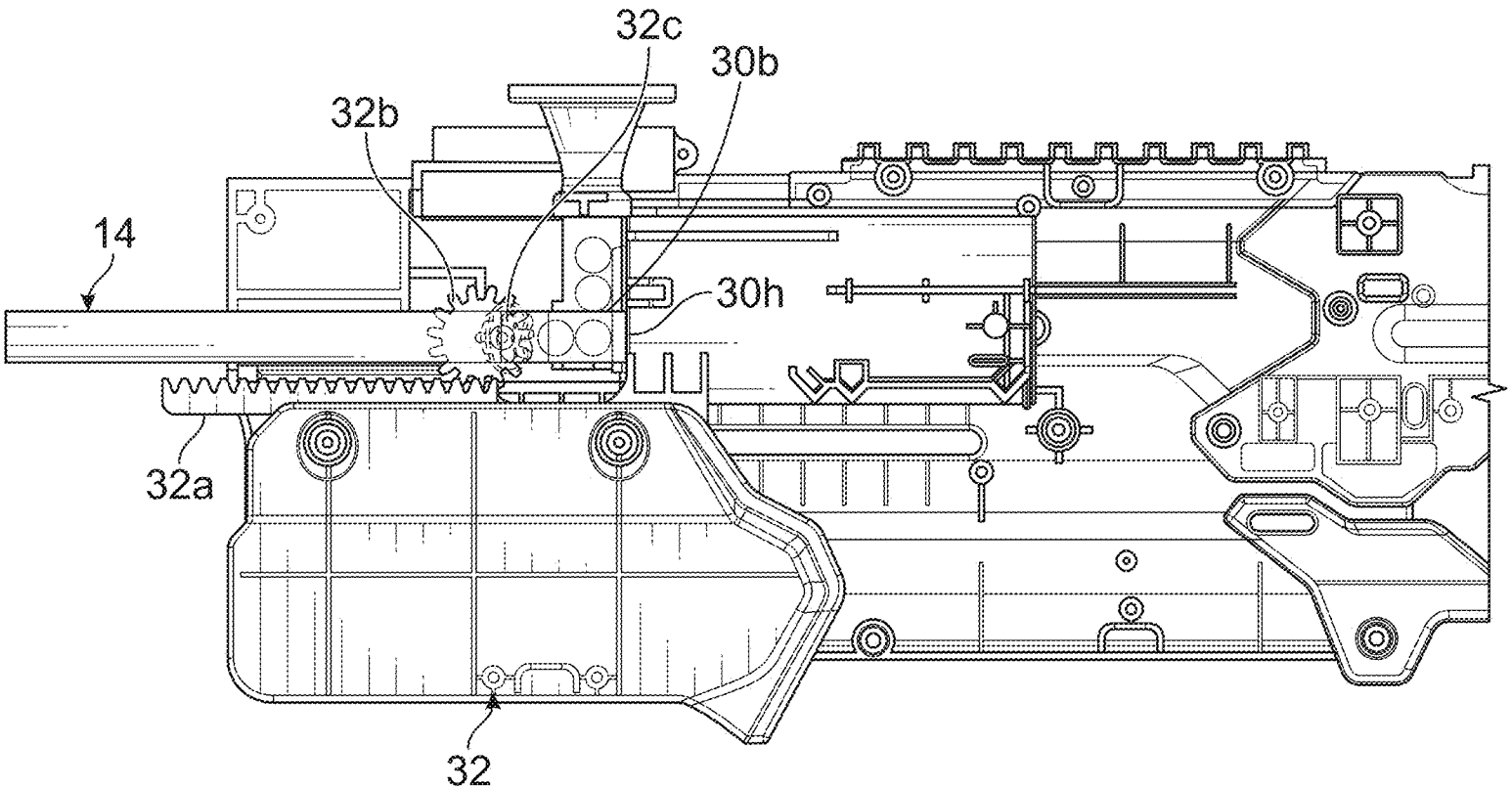

FIGS. 13A and 13B show an alternative mechanism to the piston lock and advanced lock. The trigger 16 is prevented from being pulled unless the priming handle 32 is fully advanced by the air compression element lock. The air compression element lock follower 60*b* follows the air compression element lock pathway 60*a*. The air compression element lock spring 60*c* provides a biasing force on the air compression element follower 60*b*. Only if the air compression element 36 is fully advanced does the air compression element lock follower 60*b* translate up. Otherwise, the air compression element lock latch 60*d* will engage the trigger catch 60*e* if the trigger 16 is pulled, preventing the blaster from firing.

FIGS. 14, 15, 16, 17 and 18 show an alternative mechanism to load projectile rounds 50 through the barrel seal 30*h*. The priming handle 32 has a priming handle pinion 32*a*, which engages with the barrel gear 32*b*. The barrel 14 has a barrel yoke 32*c* which engages with the barrel gear 32*b*. For every advancement and retraction of the priming handle 32, the barrel 14 advances and retracts twice. When the barrel 14 advances, a projectile round 50 enters the breech 30 from the hopper through the hopper channel 30*b*. When the barrel retracts, the projectile round 50 enters the barrel 14 through the barrel seal 30*h*. Hence for each advancement and retraction of the priming handle 32, two projectile rounds 50 enter the barrel 14.

From the foregoing, there has been provided features for an improved pneumatic launching apparatus with positioning of plural rounds from breech to alignment passages of barrels, methods, and toy air blaster apparatus with a disclosure for the method of the making the toy blaster apparatus. While particular embodiments of the improved system and apparatus have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launching apparatus, comprising:

a firing mechanism housing;

plural projectile launching barrels;

an air compression element comprising plural cylinders and plural elongated breech bolts, the breech bolts having a proximal end at the cylinders and plural breech bolt channels extending therethrough for fluid communication from the cylinders through the breech bolts for expelling compressed air from the distal ends of the breech bolts, the cylinders having a cylinder driving coupling and an air compression element lock latch;

a piston slidably received at the cylinders of the air compression element, the piston having a piston driving coupling, a piston catch and a piston spring;

plural alignment passages for alignment with the projectile launching barrels, defining a breech with a projectile round positioner within the alignment passage behind the barrel with the breech bolts of the air compression element capable of extending into the alignment passages to position a received projectile between the distal end of the breech bolt and the barrel;

a piston latch being capable of receiving the piston catch, the piston latch having a piston latch follower;

a priming handle capable of translating the air compression element, the priming handle having a priming handle interlock pathway;

a priming handle interlock follower capable of following the priming handle interlock pathway; and a trigger having a trigger cam capable of being followed by the piston latch follower, the trigger having an air compression element lock latch being capable of engaging with the air compression element lock catch.

2. The toy apparatus of claim 1, comprising a hopper at the breech for receiving two or more projectiles by gravity into the alignment passages.

3. The toy apparatus of claim 1, wherein the projectile round positioner prevents projectile rounds from exiting the breech at the alignment passages.

4. The toy apparatus of claim 1, wherein retracting the priming handle moves the air compression element to engage the air compression element driving coupling with the piston driving coupling which moves the piston.

5. The toy apparatus of claim 4, comprising an air compression element cam wherein the retraction of the piston causes the piston catch to engage with the piston latch, the piston latch preventing the piston from advancing and keeping the piston spring compressed with a lock follower.

6. The toy apparatus of claim 5, wherein full advancement of the air compression element allows the advanced lock to fully advance, any retraction of the advanced lock causes the advanced lock lever to rotate in such a way as to disengage the advanced lock lever follower from the trigger cam, the advancement of the advanced lock causes the advanced lock lever to rotate in such a way as to engage the lever follower with the trigger cam, pulling the trigger causes the advanced lock lever follower to follow the trigger cam and translate the piston lock downward releasing the piston.

7. A toy launching method, comprising:

providing a firing mechanism housing supporting plural projectile launching barrels;

driving an air compression element comprising plural cylinders and plural elongated breech bolts, the breech bolts having a proximal end at the cylinders and plural breech bolt channels extending therethrough for fluid communication from the cylinders through the breech bolts for expelling compressed air from the distal ends of the breech bolts, the cylinders having a cylinder driving coupling and an air compression element lock cam;

slidably receiving a piston at the cylinders of the air compression element, the piston having a piston driving coupling, a piston catch and a piston spring;

defining plural alignment passages for alignment with the projectile launching barrels, defining a breech with a projectile round positioner within the alignment passage behind the barrel with the breech bolts of the air compression element capable of extending into the alignment passages to position a received projectile between the distal end of the breech bolt and the barrel;

enabling a piston latch being capable of receiving the piston catch, the piston latch having a piston latch follower;

translating the air compression element with a priming handle capable, the priming handle having a priming handle interlock pathway;

providing a priming handle interlock follower capable of following the priming handle interlock pathway; and triggering using a trigger cam capable of being followed by the piston latch follower, the trigger having an air compression element lock latch being capable of engaging with the air compression element lock catch.

8. The toy launching method of claim 7, wherein the trigger being pulled causes the trigger cam to engage with the piston lock follower, piston lock to release the piston catch and the piston is propelled forward by the compressed piston spring, wherein the piston is quickly received by the air compression element, air is expelled via the fluid communication channels and the projectile rounds are fired.

9. The toy launching method of claim 7, wherein the projectile round positioner prevents projectile rounds from exiting the breech at the alignment passages.

10. The toy launching method of claim 7, wherein the priming handle interlock follows the priming handle interlock follower pathway and preventing the priming handle from advancing until it has retracted fully.

11. The toy launching method of claim 7, comprising an air compression locking step with an air compression element lock follower capable of following the air compression element lock cam, the air compression element lock having an air compression element lock latch.

12. The toy launching method of claim 7, comprising an air compression element lock being pivoted at the pivot, having a spring providing a biasing force, a latch and a follower.

13. The toy launching method of claim 12, wherein the air compression element lock is capable of following the air compression element lock cam, with the air compression element advanced rotating the air compression element such that the air compression element latch disengages from the air compression element catch with use of the trigger.

14. The toy launching method of claim 7, further comprising steps of advancing and retracting the barrel twice with each advancement and retraction of the priming handle, receiving a projectile round from the hopper after barrel advancement, the barrel receiving projectile rounds from the breech for during the retraction barrel.

* * * * *